US009127526B2

(12) United States Patent
Stephenson et al.

(10) Patent No.: US 9,127,526 B2
(45) Date of Patent: Sep. 8, 2015

(54) FAST PRESSURE PROTECTION SYSTEM AND METHOD

(71) Applicant: Halliburton Energy Services, Inc., Houston, TX (US)

(72) Inventors: Stanley V. Stephenson, Duncan, OK (US); Joseph A. Beisel, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 269 days.

(21) Appl. No.: 13/692,833

(22) Filed: Dec. 3, 2012

(65) Prior Publication Data

US 2014/0151065 A1 Jun. 5, 2014

(51) Int. Cl.
*E21B 34/06* (2006.01)
*E21B 21/10* (2006.01)

(52) U.S. Cl.
CPC ..... *E21B 34/063* (2013.01); *E21B 21/103* (2013.01); *E21B 21/106* (2013.01)

(58) Field of Classification Search
CPC ..... E21B 21/06; E21B 21/103; E21B 21/106; E21B 34/02; E21B 31/08; E21B 34/063; F16K 17/16; F16K 17/168; F16K 17/164
See application file for complete search history.

(56) References Cited

U.S. PATENT DOCUMENTS

| | | | | |
|---|---|---|---|---|
| 553,727 A | | 1/1896 | Van Sickle | |
| 1,329,559 A | | 2/1920 | Tesla | |
| 2,140,735 A | | 12/1938 | Clarke et al. | |
| 2,324,819 A | | 7/1943 | Butzbach | |
| 2,762,437 A | | 9/1956 | Egan et al. | |
| 2,849,070 A | | 8/1958 | Maly | |
| 2,945,541 A | | 7/1960 | Maly et al. | |
| 2,960,096 A | * | 11/1960 | Summers | 137/69 |
| 2,981,332 A | | 4/1961 | Miller et al. | |

(Continued)

FOREIGN PATENT DOCUMENTS

| | | |
|---|---|---|
| EP | 0834342 B1 | 2/2003 |
| EP | 1672167 A1 | 6/2006 |

(Continued)

OTHER PUBLICATIONS

"Apparatus and Method of Inducing Fluidic Oscillation in a Rotating Cleaning Nozzle," ip.com, dated Apr. 24, 2007, 3 pages.

(Continued)

*Primary Examiner* — Cathleen Hutchins
(74) *Attorney, Agent, or Firm* — John W. Wustenberg; Baker Botts L.L.P.

(57) ABSTRACT

A wellbore servicing system, the system comprising at least one wellbore servicing equipment component, wherein a flow path extends from the wellbore servicing system component into a wellbore penetrating a subterranean formation, and a pressure control system in fluid communication with the flow path, wherein the pressure control system comprises a relief path configured to communicate fluid through the pressure control system, a pressure control device configured to permit fluid communication between the flow path and the relief path upon experiencing a pressure and/or a differential pressure of at least a predetermined pressure threshold, and a first valve disposed within the relief path, wherein the first valve is configured to actuate from an open configuration to a closed configuration.

19 Claims, 4 Drawing Sheets

(56) References Cited

U.S. PATENT DOCUMENTS 2,981,333 A 4/1961 Miller et al.
3,091,393 A 5/1963 Sparrow
3,186,484 A 6/1965 Waterman
3,216,439 A 11/1965 Manion
3,233,621 A 2/1966 Manion
3,233,622 A 2/1966 Boothe
3,256,899 A 6/1966 Dexter et al.
3,266,510 A 8/1966 Wadey
3,267,946 A 8/1966 Adams et al.
3,282,279 A 11/1966 Manion
3,375,842 A 4/1968 Reader
3,427,580 A 2/1969 Brock
3,461,897 A 8/1969 Kwok
3,470,894 A 10/1969 Rimmer
3,474,670 A 10/1969 Rupert
3,477,506 A 11/1969 Malone
3,486,975 A 12/1969 Ripley
3,489,009 A 1/1970 Rimmer
3,515,160 A 6/1970 Cohen
3,521,657 A 7/1970 Ayers
3,529,614 A 9/1970 Nelson
3,537,466 A 11/1970 Chapin
3,554,209 A 1/1971 Brown et al.
3,566,900 A 3/1971 Black
3,575,804 A 4/1971 Ripley
3,586,104 A 6/1971 Hyde
3,598,137 A 8/1971 Glaze
3,620,238 A 11/1971 Kawabata
3,638,672 A 2/1972 Smith et al.
3,643,676 A 2/1972 Limage et al.
3,670,753 A 6/1972 Healey
3,704,832 A 12/1972 Fix et al.
3,712,321 A 1/1973 Bauer
3,717,164 A 2/1973 Griffin
3,730,673 A 5/1973 Straitz, III
3,745,115 A 7/1973 Olsen
3,754,576 A 8/1973 Zetterström et al.
3,756,285 A 9/1973 Johnson et al.
3,776,460 A 12/1973 Fichter
3,850,190 A 11/1974 Carlson
3,860,519 A 1/1975 Weatherford
3,876,016 A 4/1975 Stinson
3,885,627 A 5/1975 Berry et al.
3,895,901 A 7/1975 Swartz
3,927,849 A 12/1975 Kovalenko et al.
3,942,557 A 3/1976 Tsuchiya
4,003,405 A 1/1977 Hayes et al.
4,029,127 A 6/1977 Thompson
4,082,169 A 4/1978 Bowles
4,108,721 A 8/1978 Drzewiecki et al.
4,127,173 A 11/1978 Watkins et al.
4,134,100 A 1/1979 Funke
4,138,669 A 2/1979 Edison et al.
4,167,073 A 9/1979 Tang
4,167,873 A 9/1979 Bahrton
4,187,909 A 2/1980 Erbstoesser
4,268,245 A 5/1981 Straitz, III
4,276,943 A 7/1981 Holmes
4,279,304 A 7/1981 Harper
4,282,097 A 8/1981 Kuepper et al.
4,286,627 A 9/1981 Graf
4,287,952 A 9/1981 Erbstoesser
4,291,395 A 9/1981 Holmes
4,303,128 A 12/1981 Marr, Jr.
4,307,204 A 12/1981 Vidal
4,307,653 A 12/1981 Goes et al.
4,323,118 A 4/1982 Bergmann
4,323,991 A 4/1982 Holmes et al.
4,345,650 A 8/1982 Wesley
4,364,232 A 12/1982 Sheinbaum
4,364,587 A 12/1982 Samford
4,385,875 A 5/1983 Kanazawa
4,390,062 A 6/1983 Fox
4,393,928 A 7/1983 Warnock, Sr.
4,396,062 A 8/1983 Iskander
4,418,721 A 12/1983 Holmes
4,433,701 A 2/1984 Cox et al.
4,442,903 A 4/1984 Schutt et al.
4,467,833 A 8/1984 Satterwhite et al.
4,485,780 A 12/1984 Price et al.
4,491,186 A 1/1985 Alder
4,495,990 A 1/1985 Titus et al.
4,518,013 A 5/1985 Lazarus
4,526,667 A 7/1985 Parkhurst et al.
4,527,636 A 7/1985 Bordon
4,557,295 A 12/1985 Holmes
4,562,867 A 1/1986 Stouffer
4,570,675 A 2/1986 Fenwick et al.
4,570,715 A 2/1986 Van Meurs et al.
4,618,197 A 10/1986 White
4,648,455 A 3/1987 Luke
4,716,960 A 1/1988 Eastlund et al.
4,747,451 A 5/1988 Adams, Jr. et al.
4,765,184 A 8/1988 Delatorre
4,801,310 A 1/1989 Bielefeldt
4,805,407 A 2/1989 Buchanan
4,808,084 A 2/1989 Tsubouchi et al.
4,817,863 A 4/1989 Bragg et al.
4,846,224 A 7/1989 Collins, Jr. et al.
4,848,991 A 7/1989 Bielefeldt
4,857,197 A 8/1989 Young et al.
4,895,582 A 1/1990 Bielefeldt
4,911,239 A 3/1990 Winckler et al.
4,919,201 A 4/1990 Bridges et al.
4,919,204 A 4/1990 Baker et al.
4,921,438 A 5/1990 Godfrey et al.
4,930,576 A 6/1990 Berryman et al.
4,938,073 A 7/1990 Stephenson
4,945,995 A 8/1990 Tholance et al.
4,967,048 A 10/1990 Langston
4,974,674 A 12/1990 Wells
4,984,594 A 1/1991 Vinegar et al.
4,989,987 A 2/1991 Berryman et al.
4,998,585 A 3/1991 Newcomer et al.
5,026,168 A 6/1991 Berryman et al.
RE33,690 E 9/1991 Adams, Jr. et al.
5,058,683 A 10/1991 Godfrey et al.
5,076,327 A 12/1991 Mettner
5,080,783 A 1/1992 Brown
5,099,918 A 3/1992 Bridges et al.
5,154,835 A 10/1992 DeMichael
5,165,450 A 11/1992 Marrelli
5,166,677 A 11/1992 Schoenberg
5,184,678 A 2/1993 Pechkov et al.
5,202,194 A 4/1993 VanBerg, Jr.
5,207,273 A 5/1993 Cates et al.
5,207,274 A 5/1993 Streich et al.
5,211,678 A 5/1993 Stephenson et al.
5,228,508 A 7/1993 Facteau et al.
5,251,703 A 10/1993 Skinner
5,272,920 A 12/1993 Stephenson et al.
5,279,363 A 1/1994 Schultz et al.
5,282,508 A 2/1994 Ellingsen et al.
5,289,877 A 3/1994 Naegele et al.
5,303,782 A 4/1994 Johannessen
5,319,964 A 6/1994 Stephenson et al.
5,320,425 A 6/1994 Stephenson et al.
5,332,035 A 7/1994 Schultz et al.
5,333,684 A 8/1994 Walter et al.
5,335,166 A 8/1994 Stephenson
5,337,808 A 8/1994 Graham
5,337,821 A 8/1994 Peterson
5,338,496 A 8/1994 Talbot et al.
5,341,883 A 8/1994 Ringgenberg
5,343,963 A 9/1994 Bouldin et al.
5,365,435 A 11/1994 Stephenson
5,375,658 A 12/1994 Schultz et al.
5,425,424 A * 6/1995 Reinhardt et al. ..... 166/291
5,435,393 A 7/1995 Brekke et al.
5,455,804 A 10/1995 Holmes et al.
5,464,059 A 11/1995 Kristiansen
5,482,117 A 1/1996 Kolpak et al.
5,484,016 A 1/1996 Surjaatmadja et al.
5,505,262 A 4/1996 Cobb

(56) References Cited

U.S. PATENT DOCUMENTS 5,516,603 A 5/1996 Holcombe
5,533,571 A 7/1996 Surjaatmadja et al.
5,547,029 A 8/1996 Rubbo et al.
5,570,744 A 11/1996 Weingarten et al.
5,578,209 A 11/1996 Weiss
5,673,751 A 10/1997 Head et al.
5,730,223 A 3/1998 Restarick
5,803,179 A 9/1998 Echols et al.
5,815,370 A 9/1998 Sutton
5,839,508 A 11/1998 Tubel et al.
5,868,201 A 2/1999 Bussear et al.
5,893,383 A 4/1999 Facteau
5,896,076 A 4/1999 van Namen
5,896,928 A 4/1999 Coon
6,009,951 A 1/2000 Coronado et al.
6,015,011 A 1/2000 Hunter
6,032,733 A 3/2000 Ludwig et al.
6,078,471 A 6/2000 Fiske
6,098,020 A 8/2000 den Boer
6,109,370 A 8/2000 Gray
6,109,372 A 8/2000 Dorel et al.
6,112,815 A 9/2000 Bøe et al.
6,112,817 A 9/2000 Voll et al.
6,164,375 A 12/2000 Carisella
6,176,308 B1 1/2001 Pearson
6,179,052 B1 1/2001 Purkis et al.
6,247,536 B1 6/2001 Leismer et al.
6,253,861 B1 7/2001 Carmichael et al.
6,305,470 B1 10/2001 Woie
6,315,043 B1 11/2001 Farrant et al.
6,315,049 B1 11/2001 Hickey et al.
6,320,238 B1 11/2001 Kizilyalli et al.
6,345,963 B1 2/2002 Thomin et al.
6,367,547 B1 4/2002 Towers et al.
6,371,210 B1 4/2002 Bode et al.
6,397,950 B1 6/2002 Streich et al.
6,426,917 B1 7/2002 Tabanou et al.
6,431,282 B1 8/2002 Bosma et al.
6,433,991 B1 8/2002 Deaton et al.
6,450,263 B1 9/2002 Schwendemann
6,464,011 B2 10/2002 Tubel
6,470,970 B1 10/2002 Purkis et al.
6,478,091 B1 11/2002 Gano
6,497,252 B1 12/2002 Köhler et al.
6,505,682 B2 1/2003 Brockman
6,516,888 B1 2/2003 Gunnarson et al.
6,540,263 B1 4/2003 Sausner
6,544,691 B1 4/2003 Guidotti
6,547,010 B2 4/2003 Hensley et al.
6,567,013 B1 5/2003 Purkis et al.
6,575,237 B2 6/2003 Purkis et al.
6,575,248 B2 6/2003 Zhang et al.
6,585,051 B2 7/2003 Purkis et al.
6,589,027 B2 7/2003 Ursan et al.
6,622,794 B2 9/2003 Zisk, Jr.
6,627,081 B1 9/2003 Hilditch et al.
6,644,412 B2 11/2003 Bode et al.
6,668,936 B2 12/2003 Williamson, Jr. et al.
6,672,382 B2 1/2004 Schultz et al.
6,679,324 B2 1/2004 Den Boer et al.
6,679,332 B2 1/2004 Vinegar et al.
6,691,781 B2 2/2004 Grant et al.
6,695,067 B2 2/2004 Johnson et al.
6,705,085 B1 3/2004 Braithwaite et al.
6,708,763 B2 3/2004 Howard et al.
6,719,048 B1 4/2004 Ramos et al.
6,719,051 B2 4/2004 Hailey, Jr. et al.
6,724,687 B1 4/2004 Stephenson et al.
6,725,925 B2 4/2004 Al-Ramadhan
6,742,441 B1 6/2004 Surjaatmadja et al.
6,757,243 B1 6/2004 Chaudhuri et al.
6,769,498 B2 8/2004 Hughes
6,786,285 B2 9/2004 Johnson et al.
6,812,811 B2 11/2004 Robison et al.
6,817,416 B2 11/2004 Wilson et al.
6,834,725 B2 12/2004 Whanger et al.
6,840,325 B2 1/2005 Stephenson
6,851,473 B2 2/2005 Davidson
6,851,560 B2 2/2005 Reig et al.
6,857,475 B2 2/2005 Johnson
6,857,476 B2 2/2005 Richards
6,859,740 B2 2/2005 Stephenson et al.
6,886,634 B2 5/2005 Richards
6,907,937 B2 6/2005 Whanger et al.
6,913,079 B2 7/2005 Tubel
6,935,432 B2 8/2005 Nguyen
6,957,703 B2 10/2005 Trott et al.
6,958,704 B2 10/2005 Vinegar et al.
6,959,609 B2 11/2005 Stephenson
6,967,589 B1 11/2005 Peters
6,976,507 B1 12/2005 Webb et al.
7,007,756 B2 3/2006 Lerche et al.
7,011,101 B2 3/2006 Bowe et al.
7,011,152 B2 3/2006 Soelvik
7,013,979 B2 3/2006 Richard
7,017,662 B2 3/2006 Schultz et al.
7,025,134 B2 4/2006 Byrd et al.
7,038,332 B2 5/2006 Robison et al.
7,040,391 B2 5/2006 Leuthen et al.
7,043,937 B2 5/2006 Lifson et al.
7,059,401 B2 6/2006 Bode et al.
7,063,162 B2 6/2006 Daling et al.
7,066,261 B2 6/2006 Vicente et al.
7,096,945 B2 8/2006 Richards et al.
7,097,764 B2 8/2006 Neofotistos
7,100,686 B2 9/2006 Wittrisch
7,100,688 B2 9/2006 Stephenson et al.
7,108,083 B2 9/2006 Simonds et al.
7,114,560 B2 10/2006 Nguyen et al.
7,143,832 B2 12/2006 Freyer
7,168,494 B2 1/2007 Starr et al.
7,185,706 B2 3/2007 Freyer
7,199,480 B2 4/2007 Fripp et al.
7,207,386 B2 4/2007 Brannon et al.
7,213,650 B2 5/2007 Lehman et al.
7,213,681 B2 5/2007 Birchak et al.
7,216,738 B2 5/2007 Birchak et al.
7,258,169 B2 8/2007 Fripp et al.
7,290,606 B2 11/2007 Coronado et al.
7,296,633 B2 11/2007 Bode et al.
7,318,471 B2 1/2008 Rodney et al.
7,322,409 B2 1/2008 Wittle et al.
7,322,416 B2 1/2008 Burris, II et al.
7,350,577 B2 4/2008 Howard et al.
7,353,875 B2 4/2008 Stephenson et al.
7,363,967 B2 4/2008 Burris, II et al.
7,404,416 B2 7/2008 Schultz et al.
7,405,998 B2 7/2008 Webb et al.
7,409,901 B2 8/2008 Lucas et al.
7,409,999 B2 8/2008 Henriksen et al.
7,413,010 B2 8/2008 Blauch et al.
7,419,002 B2 9/2008 Dybevik et al.
7,426,962 B2 9/2008 Moen et al.
7,440,283 B1 10/2008 Rafie
7,448,454 B2 * 11/2008 Bourgoyne et al. ..... 175/7
7,455,104 B2 11/2008 Duhon et al.
7,455,115 B2 11/2008 Loretz et al.
7,464,609 B2 12/2008 Fallet
7,468,890 B2 12/2008 Lin
7,469,743 B2 12/2008 Richards
7,520,321 B2 4/2009 Hiron et al.
7,537,056 B2 5/2009 MacDougall
7,578,343 B2 8/2009 Augustine
7,591,343 B2 9/2009 Han et al.
7,621,336 B2 11/2009 Badalamenti et al.
7,635,328 B2 12/2009 Hinman et al.
7,640,990 B2 1/2010 Ross et al.
7,644,773 B2 1/2010 Richard
7,686,078 B2 3/2010 Khomynets
7,699,102 B2 4/2010 Storm et al.
7,708,068 B2 5/2010 Hailey, Jr.
7,712,540 B2 5/2010 Loretz et al.
7,780,152 B2 8/2010 Rao
7,789,145 B2 9/2010 Patel

(56) References Cited

U.S. PATENT DOCUMENTS

| | | | |
|---|---|---|---|
| 7,802,621 | B2 | 9/2010 | Richards et al. |
| 7,814,968 | B2 | 10/2010 | Bizon |
| 7,814,973 | B2 | 10/2010 | Dusterhoft et al. |
| 7,825,771 | B2 | 11/2010 | Bhogal et al. |
| 7,828,067 | B2 | 11/2010 | Scott et al. |
| 7,832,473 | B2 | 11/2010 | Pensgaard |
| 7,849,925 | B2 | 12/2010 | Patel |
| 7,849,930 | B2 | 12/2010 | Chalker et al. |
| 7,857,050 | B2 | 12/2010 | Zazovsky et al. |
| 7,857,061 | B2 | 12/2010 | Richards |
| 7,870,906 | B2 | 1/2011 | Ali |
| 7,882,894 | B2 | 2/2011 | Nguyen et al. |
| 7,905,228 | B2 | 3/2011 | Blacker et al. |
| 7,909,088 | B2 | 3/2011 | O'Malley et al. |
| 7,909,089 | B2 | 3/2011 | Jackson |
| 7,909,094 | B2 | 3/2011 | Schultz et al. |
| 7,918,272 | B2 | 4/2011 | Gaudette et al. |
| 7,918,275 | B2 | 4/2011 | Clem |
| 7,967,074 | B2 | 6/2011 | Lake et al. |
| 7,980,265 | B2 | 7/2011 | Holmes et al. |
| 8,011,438 | B2 | 9/2011 | Edwards et al. |
| 8,016,030 | B1 | 9/2011 | Prado Garcia |
| 8,025,103 | B1 | 9/2011 | Wolinsky |
| 8,069,921 | B2 | 12/2011 | Garcia et al. |
| 8,069,923 | B2 | 12/2011 | Blanco et al. |
| 8,070,424 | B2 | 12/2011 | Priestman et al. |
| 8,083,935 | B2 | 12/2011 | Eia |
| 8,127,856 | B1 | 3/2012 | Nish et al. |
| 8,184,007 | B2 | 5/2012 | Ishikawa |
| 8,191,627 | B2 | 6/2012 | Hamid et al. |
| 8,196,665 | B2 | 6/2012 | Wolinsky |
| 8,235,103 | B2 | 8/2012 | Wright et al. |
| 8,235,118 | B2 | 8/2012 | Schultz et al. |
| 8,235,128 | B2 | 8/2012 | Dykstra et al. |
| 8,261,839 | B2 | 9/2012 | Fripp et al. |
| 8,272,443 | B2 | 9/2012 | Watson et al. |
| 8,276,669 | B2 | 10/2012 | Dykstra et al. |
| 8,289,249 | B2 | 10/2012 | Lee |
| 8,291,976 | B2 | 10/2012 | Schultz et al. |
| 8,291,979 | B2 | 10/2012 | Oddie |
| 8,302,696 | B2 | 11/2012 | Williams et al. |
| 8,322,426 | B2 | 12/2012 | Wright et al. |
| 8,327,885 | B2 | 12/2012 | Dykstra et al. |
| 8,347,957 | B2 | 1/2013 | Stephenson et al. |
| 8,356,668 | B2 | 1/2013 | Dykstra et al. |
| 8,376,047 | B2 | 2/2013 | Dykstra et al. |
| 8,381,816 | B2 | 2/2013 | Leduc et al. |
| 8,387,662 | B2 | 3/2013 | Dykstra et al. |
| 8,403,038 | B2 | 3/2013 | Russell et al. |
| 8,430,130 | B2 | 4/2013 | Dykstra |
| 8,439,116 | B2 | 5/2013 | East, Jr. et al. |
| 8,453,736 | B2 | 6/2013 | Constantine |
| 8,453,746 | B2 | 6/2013 | Hailey, Jr. et al. |
| 8,454,579 | B2 | 6/2013 | Fangrow, Jr. |
| 8,464,759 | B2 | 6/2013 | Dykstra |
| 8,466,860 | B2 | 6/2013 | Naka et al. |
| 8,474,535 | B2 | 7/2013 | Richards et al. |
| 8,506,813 | B2 | 8/2013 | Alspektor |
| 8,543,245 | B2 | 9/2013 | Heitman et al. |
| 8,544,548 | B2 | 10/2013 | Coronado et al. |
| 8,555,924 | B2 | 10/2013 | Faram et al. |
| 8,555,975 | B2 | 10/2013 | Dykstra et al. |
| 8,584,747 | B2 | 11/2013 | Eslinger |
| 8,602,106 | B2 | 12/2013 | Lopez |
| 8,606,521 | B2 | 12/2013 | Beisel et al. |
| 8,607,854 | B2 | 12/2013 | Yang |
| 8,616,283 | B2 | 12/2013 | McKeen et al. |
| 2003/0070806 | A1* | 4/2003 | Connell et al. ..... 166/255.1 |
| 2005/0110217 | A1 | 5/2005 | Wood et al. |
| 2007/0028977 | A1 | 2/2007 | Goulet |
| 2007/0193752 | A1 | 8/2007 | Kim |
| 2007/0256828 | A1 | 11/2007 | Birchak et al. |
| 2007/0257405 | A1 | 11/2007 | Freyer |
| 2008/0035330 | A1 | 2/2008 | Richards |
| 2008/0041580 | A1 | 2/2008 | Freyer et al. |
| 2008/0041581 | A1 | 2/2008 | Richards |
| 2008/0041582 | A1 | 2/2008 | Saetre et al. |
| 2008/0041588 | A1 | 2/2008 | Richards et al. |
| 2008/0251255 | A1 | 10/2008 | Forbes et al. |
| 2008/0261295 | A1 | 10/2008 | Butler et al. |
| 2008/0283238 | A1 | 11/2008 | Richards et al. |
| 2009/0000787 | A1 | 1/2009 | Hill et al. |
| 2009/0009297 | A1 | 1/2009 | Shinohara et al. |
| 2009/0009412 | A1 | 1/2009 | Warther |
| 2009/0009437 | A1 | 1/2009 | Hwang et al. |
| 2009/0041588 | A1 | 2/2009 | Hunter et al. |
| 2009/0101344 | A1 | 4/2009 | Crow et al. |
| 2009/0101354 | A1 | 4/2009 | Holmes et al. |
| 2009/0114395 | A1 | 5/2009 | Holmes et al. |
| 2009/0120647 | A1 | 5/2009 | Turick et al. |
| 2009/0159282 | A1 | 6/2009 | Webb et al. |
| 2009/0205831 | A1 | 8/2009 | Jacob |
| 2009/0218103 | A1 | 9/2009 | Aakre et al. |
| 2009/0236102 | A1 | 9/2009 | Guest et al. |
| 2009/0250224 | A1 | 10/2009 | Wright et al. |
| 2009/0277650 | A1 | 11/2009 | Casciaro et al. |
| 2009/0301730 | A1 | 12/2009 | Gweily |
| 2010/0300683 | A1 | 12/2010 | Looper et al. |
| 2010/0310384 | A1 | 12/2010 | Stephenson et al. |
| 2011/0042092 | A1 | 2/2011 | Fripp et al. |
| 2011/0042323 | A1 | 2/2011 | Sullivan, II |
| 2011/0198097 | A1 | 8/2011 | Moen |
| 2011/0203671 | A1 | 8/2011 | Doig |
| 2011/0266001 | A1 | 11/2011 | Dykstra et al. |
| 2011/0308806 | A9 | 12/2011 | Dykstra et al. |
| 2012/0061088 | A1 | 3/2012 | Dykstra et al. |
| 2012/0111577 | A1 | 5/2012 | Dykstra et al. |
| 2012/0125120 | A1 | 5/2012 | Dykstra |
| 2012/0211243 | A1 | 8/2012 | Dykstra et al. |
| 2012/0234557 | A1 | 9/2012 | Dykstra et al. |
| 2012/0255739 | A1 | 10/2012 | Fripp et al. |
| 2012/0255740 | A1 | 10/2012 | Fripp et al. |
| 2012/0305243 | A1 | 12/2012 | Hallundb k et al. |
| 2013/0020088 | A1 | 1/2013 | Dyer et al. |
| 2013/0075107 | A1 | 3/2013 | Dykstra et al. |
| 2013/0255960 | A1 | 10/2013 | Fripp et al. |

FOREIGN PATENT DOCUMENTS

| | | | |
|---|---|---|---|
| EP | 1857633 | A2 | 11/2007 |
| EP | 2383430 | A2 | 11/2011 |
| EP | 2672059 | A1 | 12/2013 |
| GB | 2314866 | A | 11/1998 |
| GB | 2341405 | A | 3/2000 |
| GB | 2356879 | A | 6/2001 |
| GB | 2371578 | A | 7/2002 |
| WO | 0063530 | A1 | 10/2000 |
| WO | 0214647 | A1 | 2/2002 |
| WO | 02059452 | A1 | 8/2002 |
| WO | 02075110 | A1 | 9/2002 |
| WO | 02090714 | A1 | 11/2002 |
| WO | 03062597 | A1 | 7/2003 |
| WO | 2004012040 | A2 | 2/2004 |
| WO | 2004057715 | A2 | 7/2004 |
| WO | 2004081335 | A2 | 9/2004 |
| WO | 2005090741 | A1 | 9/2005 |
| WO | 2005116394 | A1 | 12/2005 |
| WO | 2006003112 | A1 | 1/2006 |
| WO | 2006003113 | A1 | 1/2006 |
| WO | 2006015277 | A1 | 2/2006 |
| WO | 2008024645 | A2 | 2/2008 |
| WO | 2008024645 | A3 | 2/2008 |
| WO | 2008053364 | A2 | 5/2008 |
| WO | 2008053364 | A3 | 5/2008 |
| WO | 2009048822 | A2 | 4/2009 |
| WO | 2009048823 | A2 | 4/2009 |
| WO | 2009052076 | A2 | 4/2009 |
| WO | 2009052103 | A2 | 4/2009 |
| WO | 2009052149 | A2 | 4/2009 |
| WO | 2009067021 | A2 | 5/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |

(56) References Cited

FOREIGN PATENT DOCUMENTS

| | | | |
|---|---|---|---|
| WO | 2010030266 | A1 | 3/2010 |
| WO | 2010030422 | A1 | 3/2010 |
| WO | 2010030422 | A9 | 3/2010 |
| WO | 2010030423 | A1 | 3/2010 |
| WO | 2011002615 | A2 | 1/2011 |
| WO | 2011041674 | A2 | 4/2011 |
| WO | 2012138681 | A2 | 10/2012 |
| WO | 2012138681 | A3 | 10/2012 |

OTHER PUBLICATIONS

Foreign communication from a counterpart application—Canadian Office Action, Application No. 2,737,998, Jun. 21, 2013, 3 pages.
Fripp, Michael, et al., "Development of a High-Temperature Rechargeable Battery for Downhole Use in the Petroleum Industry," OTC 19621, 2008, 8 pages, Offshore Technology Conference.
The Lee Company brochure entitled "Flosert—Constant Flow Rate," Dec. 2002, 1 page.
The Lee Company Technical Center, "Technical Hydraulic Handbook," 11th Edition, © 1971-2009, 7 pages.
Savkar, Sudhir D., Dissertation, "An Experimental Study of Switching in a Bistable Fluid Amplifier," The University of Michigan Industry Program of the College of Engineering, Dec. 1966, 137 pages.
Takebayashi, Masahiro, et al., International Compressor Engineering Conference, Paper 597, "Discharge Characteristics of an Oil Feeder Pump Using Nozzle Type Fluidic Diodes for a Horizontal Compressor Depending on the Driving Speed," 1988, pp. 19-26 plus 1 cover page, Purdue University.
Wright, Perry, et al., "The Development and Application of HT/HP Fiber-Optic Connectors for Use on Subsea Intelligent Wells," OTC 15323, 2003, pp. 1-8, Offshore Technology Conference.
Angrist, Stanley W., "Fluid Control Devices," Scientific American, Dec. 1964, pp. 80-88.
Crow, S. L., et al., "Means for Passive Inflow Control Upon Gas Breakthrough," SPE 102208, 2006, pp. 1-6, Society of Petroleum Engineers.
Filing receipt and specification for patent application entitled "Method and Apparatus for Autonomous Downhole Fluid Selection with Vortex Assembly," by Michael Linley Fripp, et al., filed Aug. 18, 2009 as U.S. Appl. No. 12/542,695.
Filing receipt and specification for patent application entitled "Wellhead Flowback Control System and Method," by Stanley V. Stephenson, et al., filed Dec. 3, 2012 as U.S. Appl. No. 13/692,839.
"Fluidics," Microsoft® Encarta® Online Encyclopedia 2009, http://encarta.msn.com/text_761578292__1/Fluidics.html, 1 page, downloaded from website on Aug. 13, 2009, © 1993-2009 by Microsoft Corporation.
Foreign communication from a counterpart application—Australian Examination Report, AU 2007315792, Mar. 31, 2010, 1 page.
Foreign communication from a counterpart application—Chinese Office Action, CN 200580016654.2, Feb. 27, 2009, 6 pages.
Foreign communication from a counterpart application—European Search Report, EP 11164202.1, Dec. 7, 2011, 6 pages.
Foreign communication from a counterpart application—United Kingdom Search Report, GB 0707831.4, Jul. 19, 2007, 3 pages.
Foreign communication from a counterpart application—International Search Report, PCT/NO02/00158, Aug. 28, 2002, 2 pages.
Foreign communication from a counterpart application—International Preliminary Examination Report, PCT/NO02/00158, Jul. 2, 2003, 3 pages.
Foreign communication from a counterpart application—International Search Report and Written Opinion, PCT/US07/75743, Feb. 11, 2008, 4 pages.
Foreign communication from a counterpart application—International Preliminary Report on Patentability, Feb. 24, 2009, PCT/US07/75743, 4 pages.
Foreign communication from a counterpart application—International Search Report and Written Opinion, Feb. 27, 2009, PCT/IB07/04287, 4 pages.
Foreign communication from a counterpart application—International Preliminary Report on Patentability, Jul. 28, 2009, PCT/IB2007/004287, 4 pages.
Foreign communication from a related counterpart application—International Search Report and Written Opinion, PCT/US2010/059121, Oct. 13, 2011, 10 pages.
Foreign communication from a counterpart application—International Preliminary Report on Patentability, Jun. 12, 2012, PCT/US2010/059121, 7 pages.
Foreign communication from a related counterpart application—International Search Report and Written Opinion, Oct. 29, 2012, PCT/US2012/032044, 9 pages.
Foreign communication from a related counterpart application—International Preliminary Report on Patentability, Oct. 8, 2013, PCT/US2012/032044, 6 pages.
Freyer, Rune, et al. "An Oil Selective Inflow Control System," SPE 78272, 2002, pp. 1-8, Society of Petroleum Engineers Inc.
Gebben, Vernon D., "Vortex Valve Performance Power Index," NASA TM X-52257, May 1967, pp. 1-14 plus 2 cover pages and Figures 1-8, National Aeronautics and Space Administration.
Haakh, Dr.-Ing. Frieder, "Vortex chamber diodes as throttle devices in pipe systems. Computation of transient flow," 2003, pp. 53-59, vol. 41, No. 1, Journal of Hydraulic Research.
Holmes, Allen B., et al., "A Fluidic Approach to the Design of a Mud Pulser for Bore-Hole Telemetry While Drilling," Technical Memorandum, DRCMS Code: 7-36AA-7100, HDL Project: A54735, Aug. 1979, pp. 1, 2, 5, 6, 9-27, and 29-37, Department of the Interior, U.S. Geological Survey, Washington, D.C.
Kirshner, Joseph M., et al., "Design Theory of Fluidic Components", 1975, pp. 276-283, 382-389, plus cover page, Academic Press, A Subsidiary of Harcourt Brace Jovanovich, Publishers.
Kirshner, Joseph M., "Fluid Amplifiers," pp. 187-193, 228, 229, plus cover page, McGraw-Hill Book Company.
"Lee Restrictor Selector," Product Brochure, Jan. 2011, 9 pages, The Lee Company, USA.
Lindeburg, Michael R., "Mechanical Engineering Reference Manual for the PE Exam," Twelfth Edition, 2006, pp. 17-16 to 17-17 plus 2 pages cover and publishing information, Professional Publications, Inc.
NuVision product profile entitled "Vortex Diode Pumps: No Moving Part Pumping Systems," 2 pages, NuVision Engineering.
Office Action dated Oct. 29, 2012 (42 pages), U.S. Appl. No. 12/700,685, filed Feb. 4, 2010.
Office Action (Final) dated Jul. 1, 2013 (38 pages), U.S. Appl. No. 12/700,685, filed Feb. 4, 2010.
Office Action dated Dec. 26, 2013 (47 pages), U.S. Appl. No. 12/700,685, filed Feb. 4, 2010.
Tesař, V., "Fluidic Valve for Reactor Regeneration Flow Switching," Chemical Engineering Research and Design, Trans IChemE, Part A, pp. 398-408, Mar. 2004, vol. 82, No. A3, Institution of Chemical Engineers.
Tesař, V., "Fluidic Valves for Variable-Configuration Gas Treatment," Chemical Engineering Research and Design, Trans IChemE, Part A, pp. 1111-1121, Sep. 2005, vol. 83, No. A9, Institution of Chemical Engineers.
Tesař, Václav, et al., "New Ways of Fluid Flow Control in Automobiles: Experience with Exhaust Gas Aftertreatment Control," F2000H192, FISITA World Automotive Congress, Jun. 12-15, 2000, Seoul, Korea, pp. 1-8.
Tesař, V., "Sampling by Fluidics and Microfluidics," Acta Polytechnica, 2002, pp. 41-49, vol. 42, No Feb. 2002, Czech Technical University Publishing House.
Weatherford product brochure entitled, "Application Answers—Combating Coning by Creating Even Flow Distribution in Horizontal Sand-Control Completions," 2005, 4 pages, Weatherford International Ltd.
Willingham, J. D., et al., "Perforation Friction Pressure of Fracturing Fluid Slurries," SPE 25891, 1993, pp. 479-491 plus 1 page corrected drawing, Society of Petroleum Engineers, Inc.
Foreign communication from a related counterpart application—European Search Report, EP 13182098.7, Nov. 13, 2013, 7 pages.

* cited by examiner

FAST PRESSURE PROTECTION SYSTEM AND METHOD

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations that contain hydrocarbons to allow for the recovery of the hydrocarbons. Once the wellbore has been drilled, various servicing and/or completion operations may be performed to configure the wellbore for the production of the hydrocarbons. Various wellbore servicing equipment components may be used during the servicing and/or completion operations, for example, to perform a servicing operation, completion operation, or combinations thereof. Many servicing and/or completion operations utilize relatively high pressures and/or relatively high fluid velocities, thereby requiring that one or more of such wellbore servicing equipment components be subjected to such high fluid pressures and/or high fluid velocities, for example, during the performance of such servicing or completion operations. As such, a sudden flow stoppage or blockage, whether intended or unintended, may result in an increase in pressure (e.g., an "over-pressuring" situation) which may be experienced by the equipment and may damage and/or render unsuitable for further use (e.g., unsafe) any such wellbore servicing equipment components (e.g., fluid conduits or "iron," pumps, wellheads, manifolds, or any other related equipment). Moreover, such over-pressuring situations may pose substantial safety risks to personnel. As such, there is a need for dealing with such over-pressuring situations.

SUMMARY

Disclosed herein is a wellbore servicing system, the system comprising at least one wellbore servicing equipment component, wherein a flow path extends from the wellbore servicing system component into a wellbore penetrating a subterranean formation, and a pressure control system in fluid communication with the flow path, wherein the pressure control system comprises a relief path configured to communicate fluid through the pressure control system, a pressure control device configured to permit fluid communication between the flow path and the relief path upon experiencing a pressure and/or a differential pressure of at least a predetermined pressure threshold, and a first valve disposed within the relief path, wherein the first valve is configured to actuate from an open configuration to a closed configuration.

Also disclosed herein is a method of servicing a wellbore, the method comprising providing a flow path between a wellbore servicing system and a wellbore penetrating a subterranean formation, wherein a pressure control system comprising a pressure control device and a relief path is in fluid communication with the flow path, wherein the pressure control system is configured to control fluid communication between the flow path and the relief path, communicating a fluid via the flow path, and upon experiencing a pressure and/or a differential pressure of at least a predetermined pressure threshold within the flow path, allowing fluid to be communicated from the flow path through the relief path, wherein the pressure control device permits fluid communication from the flow path to the relief path within about 0.10 seconds of experiencing the pressure and/or the differential pressure of at least the predetermined pressure threshold.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
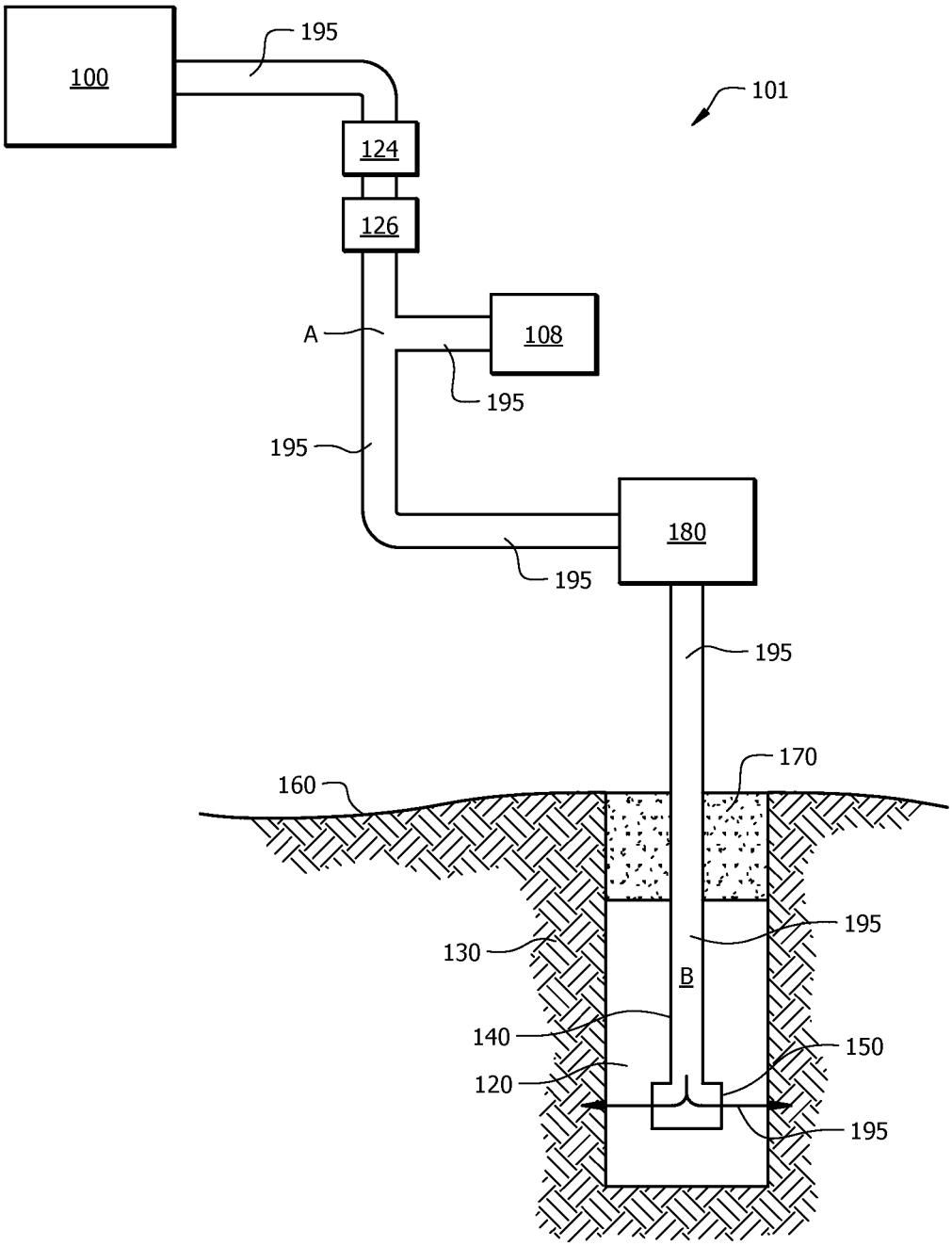
FIG. 1 is a partial cutaway view of an operating environment of a pressure control system.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward," meaning toward the surface of the wellbore and with "down," "lower," or "downward," meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line from the main axis of the wellbore, a wellbore tubular, and/or an element generally outward. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein are embodiments of devices, systems, and methods utilized to quickly and efficiently dissipate excessive pressures within a wellbore servicing system, for example, which may occur during the performance of a wellbore servicing operation (e.g., an over-pressuring situation). In an embodiment, the devices, systems, and/or methods disclosed herein may be effective to protect one or more wellbore servicing equipment components (for example, surface equipment, such as pumps, manifolds, or mixers; equipment associated with a wellbore, such as wellheads, work strings, casing strings, or production strings; various downhole equipment; flow lines or conduits; or combinations thereof) from damage that may result upon exposure to excessive pressures (e.g., an over-pressuring situation).

FIG. 1 schematically illustrates an embodiment of a wellsite 101. In the embodiment of FIG. 1, a wellbore servicing system 100 is deployed at the wellsite 101 and is fluidicly coupled to a wellbore 120. The wellbore 120 penetrates a subterranean formation 130, for example, for the purpose of recovering hydrocarbons, storing hydrocarbons, disposing of carbon dioxide, or the like. The wellbore 120 may be drilled into the subterranean formation 130 using any suitable drilling technique. In an embodiment, a drilling or servicing rig may comprise a derrick with a rig floor through which a pipe string 140 (e.g., a casing string, production string, work string, drill string, segmented tubing, coiled tubing, etc., or combinations thereof) may be lowered into the wellbore 120. The drilling or servicing rig may be conventional and may comprise a motor driven winch and other associated equipment for lowering the pipe string 140 into the wellbore 120. Alternatively, a mobile workover rig, a wellbore servicing unit (e.g., coiled tubing units), or the like may be used to lower the pipe string 140 into the wellbore 120.

The wellbore 120 may extend substantially vertically away from the earth's surface 160 over a vertical wellbore portion, or may deviate at any angle from the earth's surface 160 over a deviated or horizontal wellbore portion. Alternatively, portions or substantially all of the wellbore 120 may be vertical, deviated, horizontal, and/or curved. In some instances, a portion of the pipe string 140 may be secured into position within the wellbore 120 in a conventional manner using cement 170; alternatively, the pipe string 140 may be partially cemented in the wellbore 120; alternatively, the pipe string 140 may be uncemented in the wellbore 120; alternatively, all or a portion of the pipe string 140 may be secured using one or more packers (e.g. mechanical or swellable packers, such as SWELLPACKER isolation systems, commercially available from Halliburton Energy Services). In an embodiment, the pipe string 140 may comprise two or more concentrically positioned strings of pipe (e.g., a first pipe string such as jointed pipe or coiled tubing may be positioned within a second pipe string such as casing cemented within the wellbore). It is noted that although one or more of the figures may exemplify a given operating environment, the principles of the devices, systems, and methods disclosed may be similarly applicable in other operational environments, such as offshore and/or subsea wellbore applications.

In the embodiment of FIG. 1, a wellbore servicing apparatus 150 configured for one or more wellbore servicing and/or production operations may be integrated within (e.g., in fluid communication with) the pipe string 140. The wellbore servicing apparatus 150 may be configured to perform one or more servicing operations, for example, fracturing the formation 130, hydrajetting and/or perforating casing (when present) and/or the formation 130, expanding or extending a fluid path through or into the subterranean formation 130, producing hydrocarbons from the formation 130, various other servicing operations, or combinations thereof. In an embodiment, the wellbore servicing apparatus 150 may comprise one or more ports, apertures, nozzles, jets, windows, or combinations thereof for the communication of fluid from a flowbore of the pipe string 140 to the subterranean formation 130 or vice versa. In an embodiment, the wellbore servicing apparatus 150 may be selectively configurable to provide a route of fluid communication between the wellbore servicing apparatus 150 and the wellbore 120, the subterranean formation 130, or combinations thereof. In an embodiment, the wellbore servicing apparatus 150 may be configurable for the performance of multiple servicing operations. In an embodiment, additional downhole tools, for example, one or more isolation devices (for example, a packer, such as a swellable or mechanical packer), may be included within and/or integrated within the wellbore servicing apparatus 150 and/or the pipe string 140, for example a packer located above and/or below wellbore servicing apparatus 150.

Figure 2:
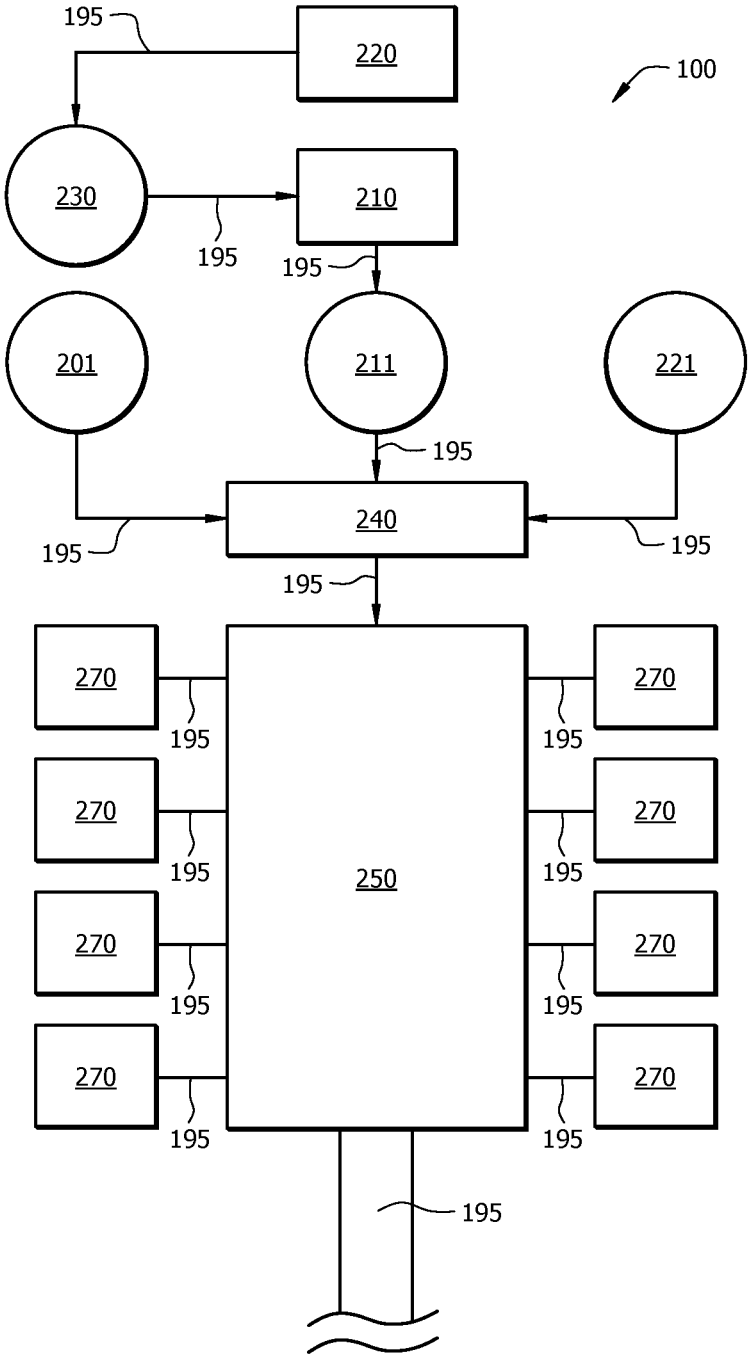
FIG. 2 is a schematic illustration of a wellbore servicing system.

In an embodiment, the wellbore servicing system 100 is generally configured to communicate (e.g., introduce) a fluid (e.g., a wellbore servicing fluid) into wellbore 120, for example, at a rate and pressure suitable for the performance of a desired wellbore servicing operation. In an embodiment, the wellbore servicing system 100 comprises at least one wellbore servicing system equipment component. Turning to FIG. 2, an embodiment of the wellbore servicing system 100 is illustrated. In the embodiment of FIG. 2, the wellbore servicing system 100 may comprise a fluid treatment system 210, a water source 220, one or more storage vessels (such as storage vessels 230, 201, 211, and 221), a blender 240, a wellbore servicing manifold 250, one or more high pressure pumps 270, or combinations thereof. In the embodiment of FIG. 2, the fluid treatment system 210 may obtain water, either directly or indirectly, from the water source 220. Water from the fluid treatment system 210 may be introduced, either directly or indirectly, into the blender 240 where the water is mixed with various other components and/or additives to form the wellbore servicing fluid or a component thereof (e.g., a concentrated wellbore servicing fluid component).

Returning to FIG. 1, in an embodiment, the wellbore servicing system 100 may be fluidicly connected to a wellhead 180, and the wellhead 180 may be connected to the pipe string 140. In various embodiments, the pipe string 140 may comprise a casing string, production string, work string, drill string, a segmented tubing string, a coiled tubing string, a liner, or combinations thereof. The pipe string 140 may extend from the earth's surface 160 downward within the wellbore 120 to a predetermined or desirable depth, for example, such that the wellbore servicing apparatus 150 is positioned substantially proximate to a portion of the subterranean formation 130 to be serviced (e.g., into which a fracture is to be introduced) and/or produced.

In an embodiment, for example, in the embodiment of FIGS. 1 and 2, a flow path formed by a plurality of fluidicly coupled conduits, collectively referred to as flow path 195, may extend through at least a portion of the wellbore servicing system 100, for example, thereby providing a route of fluid communication through the wellbore servicing system 100 or a portion thereof. As depicted in the embodiment of FIGS. 1 and 2, the flow path 195 may extend from (and/or through) the wellbore servicing system 100 to the wellhead 180, through the pipe string 140, into the wellbore 120, into the subterranean formation 130, vice-versa (e.g., flow in either direction into or out of the wellbore), or combinations thereof. Persons of ordinary skill in the art with the aid of this disclosure will appreciate that the flow paths 195 described herein or a similar flow path may include various configurations of piping, tubing, etc. that are fluidly connected to each other and/or to one or more components of the wellbore servicing system 100 (e.g., pumps, tanks, trailers, manifolds, mixers/blenders, etc.), for example, via flanges, collars, welds, pipe tees, elbows, and the like.

In an embodiment, for example, as illustrated in FIG. 1, the wellbore servicing system 100 may be fluidicly connected to the wellhead 180 via a check valve 126 and a relief valve 124, for example, the check valve 126 and the relief valve 124 are disposed along the flow path 195 between the wellbore servicing system 100 and the wellhead 180. In the embodiment of FIG. 1, the check valve 126 may be located downstream relative to the relief valve 124, for example, the check valve may be located relatively closer to the wellhead 180.

In such an embodiment, the relief valve 124 may be configured to relieve pressure within the flow path 195 when fluid pressure increases to or beyond a threshold pressure (e.g., when the relief valve experiences a given activation or "pop-off" pressure). For example, the relief valve may be configured such that pressure in excess of such a threshold pressure is allowed to flow out of the flow path via the relief valve. The relief valve 124 may comprise any suitable type and/or configuration thereof, examples of which include, but are not limited to, a pop-off valve and a bypass valve. As will be appreciated by one of skill in the art upon viewing this disclosure, relief valves 124 generally comprise mechanical devices.

In an embodiment, the check valve 126 may be configured to allow fluid communication therethrough in a first direction and to prohibit fluid movement in a second direction. For example, in the embodiment of FIG. 1, the check valve 126 may generally be configured to allow fluid communication from the wellbore servicing system 100 in the direction of the wellbore 120 (e.g., "forward" fluid movement) and to prohibit fluid communication from the wellbore 120 in the direction of the wellbore servicing system 100 (e.g., "reverse" fluid movement). The check valve 126 may comprise any suitable type and/or configuration thereof, examples of which include, but are not limited to, a flapper valve, a ball check valve, a diaphragm check valve, a swing check valve, a titling disc check valve, a stop-check valve, a lift-check valve, an in-line check valve, duckbill valve, or combinations thereof.

In an alternative embodiment, the wellbore servicing system 100 may be fluidicly connected to the wellhead 180 without a check valve (e.g., check valve 126) or a relief valve (e.g., relief valve 124). For example, in such an alternative embodiment, the check valve 126 and the relief valve 124 may be absent from the flow path 195 between the wellbore servicing system 100 and the wellhead 180.

Referring again to FIG. 1, in an embodiment a pressure control system 108, as will be disclosed herein, may be present at the wellsite 101 and positioned along (e.g., in fluid communication with) the flow path 195 extending through the wellbore servicing system 100 and to the wellhead 180, alternatively, through the pipe string 140, alternatively, into the wellbore 120, alternatively, to/into the subterranean formation 130. For example, in the embodiment of FIG. 1, the pressure control system 108 is in fluid communication with the flow path 195 at a position (e.g., denoted "A" in FIG. 1) generally between the wellbore servicing system 100 and the wellhead 180; particularly, at a position between the check valve 126 and the wellhead 180.

In an alternative embodiment, the pressure control system 108 may be in fluid communication with the flow path 195 at a suitable alternative location. For example, in an embodiment, the pressure control system 108 may be in fluid communication with the flow path 195 at a position (e.g., denoted "B" in FIG. 1) generally within (e.g., integrated and/or incorporated within) the pipe string 140, for example, below the wellhead 180 and thus, sub-surface. In another alternative embodiment, the pressure control system 108 may be in fluid communication with the flow path at a position within the wellbore servicing system 100. As will be disclosed herein, the position at which the pressure control system 108 is in fluid communication with the flow path 195 may affect the type and/or configuration of pressure control system 108 that is utilized.

Also, while the embodiment of FIG. 1 illustrates a single pressure control system 108, in additional or alternative embodiments multiple pressure control systems 108 (e.g., two three, four, five, six, seven, eight, or more) may be utilized. In an embodiment where such multiple pressure control systems 108 are utilized, the pressure control systems 108 may located the same position along the flow path 195; alternatively, the pressure control systems 108 may be located at two or more positions along the flow path.

In an embodiment, the pressure control system 108 may be generally configured to quickly relieve pressure within the flow path 195 when fluid pressure increases to at least a pressure threshold (e.g., when the pressure control system 108 or a component thereof experiences a pressure of at least a predetermined activation threshold). In an embodiment, the pressure control system 108 may also be configured to retain control of the wellbore and associated servicing equipment, for example, to control the escape of fluids from the flow path 195. For example, in an embodiment, the pressure control system 108 may be configured so as to allow pressure (e.g., fluid, such as a wellbore servicing fluid and/or produced fluids such as hydrocarbons) to be discharged therefrom and, following the pressure discharge, to recover control of the wellbore and associated equipment such that the wellbore and associated equipment (e.g., flow path 195) does not remain open for more than a predetermined duration. In an embodiment as will be disclosed herein, the pressure control system 108 may be effective to protect the integrity of the flow path 195 (e.g., including one or more of the components of the wellbore servicing system 100, the wellhead 180, the pipe string 140, the wellbore servicing apparatus 150, or combinations thereof), for example, by ensuring that no component of the flow path 195 experiences a pressure in excess of the pressure threshold. In an embodiment, the pressure threshold (e.g., above which, the pressure control system 108 will discharge any excess pressure) may be selected by one of skill in the art upon viewing this disclosure but, generally, is a pressure less than the maximum pressure for which one or more of the components along the flow path is rated (e.g., the maximum pressure for which a tubular or iron is rated). For example, in an embodiment, the pressure threshold may be about 1,000 psi., alternatively, about 2,500 psi., alternatively, about 5,000 psi., alternatively, about 7,500 psi., alternatively, about 10,000 psi, alternatively, about 15,000 psi., alternatively, about 20,000 psi., alternatively, about 25,000 psi, alternatively, about 30,000 psi., alternatively, about 35,000 psi., alternatively, about 40,000 psi., alternatively, about 45,000 psi., alternatively, about 50,000 psi.

For example, in an embodiment, the pressure control system 108 may relieve (e.g., discharge) excess pressures within the flow path 195, thereby safeguarding (e.g., prohibiting) one or more components of the wellbore servicing system 100 (or any other component in fluid communication such as shown in FIG. 1) against yield due to experiencing an excessive pressure (e.g., a pressure of greater than the maximum pressure for which a tool or component is rated). As used herein, yield may refer to any fracturing, bending, collapsing, rupturing, plastic deformation, or otherwise compromising of the structural integrity experienced by a mechanical or structural component. As will be appreciated by one of skill in the art upon viewing this disclosure, yield is not limited to readily observable deformations (breaks, fractures, ruptures, tears, or the like), but may also include less readily observable changes (e.g., at a microscopic or molecular level) which may nonetheless compromise the structural integrity of such components.

As will be disclosed herein, the configuration of the pressure control system 108 may vary depending upon factors including, but not limited to, the intended servicing operation being performed, the intended flow-rate of fluids within the flow path 195, the intended pressures within the flow path 195, and the position at which the pressure control system 108 is incorporated within the flow path 195.

Figure 3:
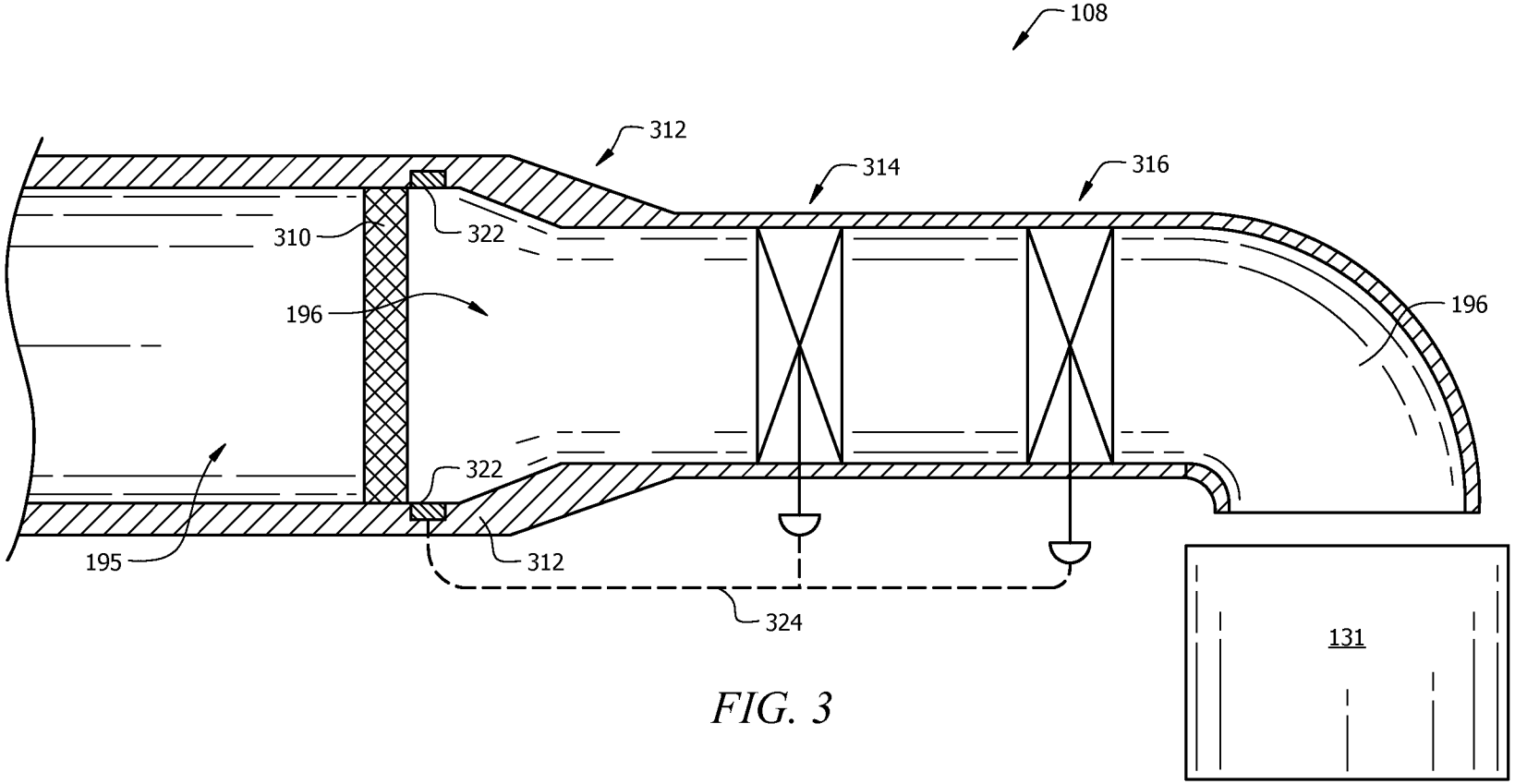
FIG. 3 is a partial cutaway view of a first embodiment of a pressure control system.

Referring to FIG. 3, a first embodiment of the pressure control system 108 is illustrated. In an embodiment, the first embodiment of the pressure control system 108 illustrated in FIG. 3 may be suitably incorporated/integrated within the flow path 195 at a position above the surface of the formation (e.g., at location A, as shown in FIG. 1). In the embodiment of FIG. 3, the pressure control system 108 generally comprises a pressure control device 310, a relief flow path 196, and a first valve 314. In an embodiment, the pressure control system 108 (e.g., the first embodiment of the pressure control system as shown in FIG. 3) may further comprise a flow restrictor 312, at least one sensor 322, a second valve 316, a relief space 131, or combinations thereof.

In an embodiment, the pressure control device 310 may be generally configured to permit fluid communication between the flow path 195 and a relief path 196 when the differential pressure across the pressure control device 310 reaches a predetermined threshold. For example, in an embodiment, the pressure control device 310 may permit fluid communication between the flow path 195 and the relief path 196 when the differential pressure across the pressure control device 310 increases to at least the pressure threshold. In an embodiment, the change in differential pressure across the pressure control device 310 may be associated with (e.g., substantially with) a change in pressure within the flow path 195. For example, the pressure within the relief flow path 196 may be relatively constant and the pressure within the flow path 195 may vary (e.g., during the movement of fluids therethrough), so that an increase in the differential pressure across the pressure control device 310 may be substantially the result of an increase in pressure within the flow path 195. For example, the pressure within the relief path may be about atmospheric/ambient pressure. As such, the differential pressure across the pressure control device may be about equal to (e.g., approximately) the pressure threshold. For example, in an embodiment, the differential in pressure at which the pressure control device is configured to allow fluid communication to the relief flow path 196 may be about 1,000 psi., alternatively, about 2,500 psi., alternatively, about 5,000 psi., alternatively, about 7,500 psi., alternatively, about 10,000 psi, alternatively, about 15,000 psi., alternatively, about 20,000 psi., alternatively, about 25,000 psi, alternatively, about 30,000 psi., alternatively, about 35,000 psi., alternatively, about 40,000 psi., alternatively, about 45,000 psi., alternatively, about 50,000 psi. In an alternative embodiment, the pressure control device may be configured to permit fluid communication between the flow path 195 and a relief path 196 when the absolute pressure within the flow path 195 reaches the pressure threshold.

In an embodiment, the pressure control device 310 be actuated (e.g., so as to allow fluid communication) upon experiencing a pressure differential across the pressure control device 310 of at least the pressure threshold. In an embodiment, the pressure control device 310 may be configured so as to initially seal and/or separate the flow path 195 from the relief path 196. In an embodiment, the pressure control device 310 may be characterized as a fast-acting device. For example, such a fast-acting device may refer to a device that will be actuated (e.g., so as to allow fluid communication) instantaneously, alternatively, substantially instantaneously, upon experiencing the pressure threshold. For example, in an embodiment the pressure control device 310 (e.g., a fast-acting device) may be actuated (e.g., so as to communicate fluid) in less than or equal to about 0.01 seconds from experiencing the pressure threshold, alternatively, within about 0.02 secs., alternatively, about 0.03 secs., alternatively, about 0.04 secs., alternatively, about 0.05 secs., alternatively, about 0.06 secs., alternatively, about 0.07 secs., alternatively, about 0.08 secs., alternatively, about 0.09 secs., alternatively, about 0.10 secs.

In an embodiment, the pressure control device 310 may comprise a burst disc or rupture disc. For example, in such an embodiment, the pressure control device 310 (i.e., a burst disc or rupture disc) may be configured to break, puncture, perforate, shear, fragment, disintegrate, explode, implode, tear or combinations thereof upon experiencing a pressure or pressure differential of at least the pressure threshold. In such an embodiment, upon actuation (e.g., breaking, puncturing, perforating, shearing, fragmenting, disintegrating, exploding, imploding, tearing, or combinations thereof), the pressure control device 310 may cease to block fluid movement from the flow path 195 to the relief path 196. For example, the pressure control device 310 (i.e., the burst disc or rupture disc) may be initially configured to block fluid movement via the relief path 196. Upon actuation, the pressure control device may break or fragment into small pieces which may pass through and out of the relief path 196, thereby no longer blocking the relief path 196 and permitting fluid communication between the flow path 195 and the relief path 196. In such an embodiment, the burst or rupture disc may be formed from a suitable material. Examples of such materials include, but are not limited to, ceramics, glass, graphite, plastics, metals and/or alloys (such as carbon steel, stainless steel, or Hastelloy®), deformable materials such as rubber, or combinations thereof.

In an additional or alternative embodiment, the pressure control device 310 may comprise a cap releasably engaged within the relief path 196. For example, the cap may be retained within the relief path 196 by a circumferential lip disposed over a rim. Alternatively, the cap may be retained within the relief path 196 by engaging a groove or shoulder within the relief path 196. In such an embodiment, the cap may be configured to release the relief path 196, for example, by bending, expanding, contracting, warping, or otherwise deforming, upon experiencing a pressure or pressure differential of at least the pressure threshold. For example, the pressure control device 310 (i.e., cap) may initially block fluid communication via the relief path 196, for example, by engaging the relief path 196. Upon, actuating (e.g., breaking, bending, expanding, contracting, warping, or deforming) the pressure control device 310 (i.e., the cap) may disengage the relief path (e.g., a rim, shoulder, or groove), thereby no longer blocking fluid communication via the relief path 196 and permitting fluid communication between the flow path 195 and the relief path 196. In such an embodiment, the cap may be formed from a suitable material. Examples of such materials include, but are not limited to, metals and/or metal alloys, polymeric materials, such as various plastics, natural or synthetic rubbers, ceramics, or combinations thereof.

In another additional or alternative embodiment, the pressure control device 310 may comprise a hinged assembly, for example, a flapper assembly. For example, in such an embodiment, the pressure control device may comprise a plate (e.g., the flapper) pivotably attached (e.g., via one or more arm and hinge mechanisms) within the relief path 196 such that the plate (e.g., flapper) may block fluid communication from the flow path 195 to the relief path 196 or such that the plate may pivot substantially out of the relief path 196, for example, so as to not block fluid communication from the flow path 195 to the relief path 196. For example, the plate may initially block fluid communication between the flow path 195 and the relief path 196. In an embodiment, the plate may be initially retained in the initial position by one or more frangible members, such as shear pins. In such an embodiment, the pressure control device 310 may be configured such that, upon experiencing a pressure or pressure differential of at least the pressure threshold, the frangible member(s) is sheared and/or broken, thereby allowing the plate (e.g., the flapper) to rotate out of the relief path 196. Upon actuating, the plate may be configured so as to rotate out of the relief path 196, thereby no longer blocking fluid communication via the relief path 196 and permitting fluid communication between the flow path 195 and the relief path 196.

Additionally or alternatively, in an embodiment, the pressure control device 310 may comprise a relief valve, for example, as similarly disclosed with reference to relief valve 124 disclosed herein. For example, in such an embodiment, the pressure control device may comprise a spring-loaded, hydraulically-loaded, or pneumatically-loaded relief valve, such as a poppet type valve.

In an embodiment, the pressure control device 310 may further comprise one or more sensors, electronic circuitry, and/or actuators, generally configured to monitor a parameter (e.g., pressure) and to actuate the pressure control device 310 in response to sensing a pressure within the flow path 195 of at least the pressure threshold. In such an embodiment, the sensor, electronic circuitry, and/or actuators may comprise a single integrated component, alternatively, the sensor, electronic circuitry, and/or actuators may comprise two or more distributed components. In such an embodiment, when actuated, the actuator may be configured to cause actuation of another component of the pressure control device (e.g., such as a burst or rupture disc, a cap, and/or a flapper plate), as disclosed herein. For example, upon sensing the pressure threshold, the actuator may cause a burst or rupture disc to break, or a shear pin to break.

In an embodiment, the sensor may comprise any suitable sensor (e.g., a transducer) capable of detecting a predetermined parameter and communicating with electronic circuitry to command the pressure control device 310 to actuate. For example, in an embodiment, the sensor may comprise a pressure sensor capable of detecting when the differential pressure across the pressure control device 310 and/or the pressure within the flow path 195 reaches the pressure threshold and transmitting a signal (e.g., via an electrical current) to electronic circuitry to actuate the pressure control device 310. In an embodiment, the electronic circuitry may be configured to receive a signal from the sensor, for example, so as to determine if the sensor has experienced a predetermined pressure, and, upon a determination that such a pressure has been experienced, to output an actuating signal to the pressure control device 310 and/or to an actuator. In an embodiment, the electronic circuitry may comprise any suitable configuration, for example, comprising one or more printed circuit boards, one or more integrated circuits, one or more discrete circuit components, one or more microprocessors, one or more microcontrollers, one or more wires, an electromechanical interface, a power supply and/or any combination thereof. In an embodiment, the actuator may comprise any suitable type or configuration. For example, the actuator may comprise a punch configured so as, upon actuation, to rupture a burst disc. For example, the actuator may be driven by a magnet or an explosive change.

In an embodiment, the first valve 314 is disposed along and/or within the relief path 196 and is generally configured to selectively block fluid communication through the relief path 196, for example, to actuate from an open configuration to a closed configuration. For example, in an embodiment, the first valve 314 may be configured to block fluid communication via (e.g., to seal), alternatively, to substantially block fluid communication via, the relief path 196. For example, the first valve may be configured to prevent and/or stop fluid communication through the relief path 196, for example, by obstructing all or substantially all of the cross-section of the relief path 196. In an embodiment, for example, as shown in FIG. 3, the first valve may be positioned generally downstream (e.g., further along the relief path 196) from the pressure control device 310.

In an embodiment, the first valve 314 may comprise a suitable type and/or configuration of valve. Examples of suitable types and configurations of such a valve include, but are not limited to, a gate valve, a ball valve, a globe valve, a choke valve, a butterfly valve, a pinch valve, a disc valve, the like, or combinations thereof. One of ordinary skill in the art, upon viewing this disclosure, will appreciate that various types and configurations of valves may be used as the first valve 314.

In an embodiment, the first valve 314 may be configured to actuate hydraulically, pneumatically, electrically (e.g., via the operation of a solenoid and/or a motor), manually, or combinations thereof. In an embodiment, and as will be disclosed herein, the first valve 314 may initially be provided in an open configuration (e.g., such that fluid communication is allowed therethrough).

In an embodiment, the first valve 314 may be configured to actuate upon the communication of fluid between the flow path 195 and the relief path 196, for example, upon actuation of the pressure control device 310, as disclosed herein. For example, in an embodiment, a sensor 322 exposed to the relief path 196 may be configured to sense one or more parameters, such as the presence of fluid, the presence of fluid flow, pressure, or combinations thereof, and may output a signal causing the first valve 314 to actuate (e.g., to transition from open to closed). For example, the sensor 322 may be linked (e.g., via a wired or wireless connection) to a control system 324 which may be configured to control the first valve 314. For example, the sensor 322 may comprise a flow switch, a pressure switch, or the like. In an alternative embodiment, the sensor 322 may output a signal (e.g., an alarm, a buzzer, or a siren) to alert an operator as to the communication of fluid via the relief path 196, for example, such that the operator may manually operate (e.g., close) the first valve 314. In another alternative embodiment, a sensor 322 may be absent and the first valve 314 may be manually actuated, for example, by rotating a wheel to actuate the first valve 314.

In an embodiment, the first valve 314 may be configured to actuate (e.g., to transition from the open configuration to the closed configuration) at a controlled rate. In such an embodiment, the first valve 314 may be configured to actuate (e.g., from fully open to fully closed) over a suitable duration, for example, a duration of from about 1 second to about 120 secs, alternatively, from about 2 secs. to about 90 secs., alternatively, from about 4 secs. to about 60 secs., alternatively, from about 5 secs. to about 45 secs. beginning approximately concurrent with fluid communication through the relief path (e.g., upon actuating of the pressure control device 310).

Not intending to be bound by theory, the rate at which the first valve 314 is configured to close may be dependent upon one or more factors including, but not limited to, length of the flow path (e.g., the distance from the pressure control system 108 into the wellbore 120). As will be disclosed herein, a sudden flow stoppage (e.g., at the wellhead, within the wellbore, or at any other location along the flow path 195) may result in a pressure-wave (a relatively high-pressure wave traveling within the flow path 195). For example, closing the first valve 314 too quickly could result in a water hammer pressure wave due to the sudden stoppage of fluid moving through the relief path 196. Again not intending to be bound by theory, in an embodiment, the greater the length of the flow path 195, the slower the first valve 314 may be configured to actuate, for example, so as to allow more time for the dissipation of such a pressure wave. For example, actuating (e.g., closing) the first valve 314 before such a pressure wave could be dissipated could cause the pressure wave to be trapped within the flow path 195, thereby causing damage to one or more components thereof.

Continuing to refer to FIG. 3, in an embodiment the pressure control system 108 may comprise at least one flow restrictor 312. In such an embodiment, the flow restrictor 312 may generally be configured to restrict flow (e.g., fluid movement) within and/or through the relief path 196. For example, in an embodiment, for example, in the embodiment of FIG. 3, the flow restrictor, may be positioned generally downstream (e.g., further along the relief path 196) from the pressure control device 310, for example, between the first valve 314 and the pressure control device 310. In an embodiment, the flow restrictor 312 may be configured to reduce the pressure of a fluid moving from the pressure control device 310 toward the first valve 314.

In an embodiment, the flow restrictor 312 may comprise a choke, for example, a non-regulating choke or a fixed choke. For example, the flow restrictor 312 may comprise a diameter (e.g., a cross-sectional flow area) that generally decreases (e.g., a throat) in the direction of fluid flow (e.g., decreases moving generally downstream). In an embodiment, the flow restrictor 312 may decrease the pressure of a fluid moving within the relief path 196 from the pressure control device 310 to the first valve 314. In an additional or alternative embodiment, the flow restrictor 312 may comprise a fluidic diode. In such an embodiment, the fluidic diode may operate similarly to a choke. Not intending to be bound by theory, the flow restrictor 312 may decrease the pressure of a fluid moving via the relief path 196 such that the pressure of the fluid is substantially decreased prior to reaching the first valve 314, for example, such that the moving fluid does not damage (e.g., abrade) the first valve 314 as the first valve 314 closes, for example, as will be disclosed herein. For example, in an embodiment the flow restrictor 312 may be configured such that the pressure of a fluid moving via the relief path 196 at a location downstream from the flow restrictor 312 is less than about 95% of the volume/amount of the pressure of the fluid at a location upstream from the flow restrictor 312, alternatively, less than about 90%, alternatively, less than about 85%, alternatively, less than about 80%, alternatively, less than about 75%.

Continuing to refer to FIG. 3, the pressure control system 108 may comprise a second valve 316. In such an embodiment, the second valve 316, like the first valve 314, is generally configured to selectively block fluid communication through the relief path 196, for example, to actuate from an open configuration to a closed configuration. The second valve 316 may comprise any suitable type or configuration of valve and may be configured to be suitably actuated, for example, as disclosed herein with respect to the first valve 314. In an embodiment, for example, in the embodiment of FIG. 3, the second valve 316 may be disposed within the relief path 196, for example, generally downstream (e.g., further along the relief path) from the first valve 314. The second valve 316 may be configured similarly to the first valve 314 (e.g., the same type, configuration, and/or mode of actuation), alternatively, the second valve 316 may be configured differently with respect to the first valve 314.

In an embodiment, the second valve 316 may be configured such that the second valve 316 is not fully actuated (e.g., does not reach the closed position) until after the first valve 314 has been fully actuated (e.g., until after the first valve 314 has been fully closed). For example, in an embodiment, the second valve 316 may be configured to actuate (e.g., to transition from open to closed) at a different rate relative to the first valve 314, to begin actuating later than the first valve 314, or combinations thereof. For example, the second valve 316 may be configured to actuate at a slower rate relative to the first valve 314. In such an embodiment, even if the first valve 314 and the second valve 316 are actuated (e.g., begin to transition from open to closed) substantially simultaneously, the first valve 314 may be fully actuated (e.g., closed) prior to the second valve 316 being fully actuated (e.g., closed). In such an embodiment, the second valve 316 may be configured to actuate (e.g., from fully open to fully closed) over a suitable duration, for example, a duration of from about 1 second to about 240 secs., alternatively, from about 2 secs. to about 120 secs., alternatively, from about 4 secs. to about 90 secs., alternatively, from about 5 secs. to about 60 secs.

Additionally or alternatively, the second valve 316 may be configured to be actuated (e.g., begin to transition from open to closed) after the first valve 314 is at least partially actuated (e.g., closed), for example, after the first valve 314 is at least about ¼ actuated, alternatively, at least about ½ actuated, alternatively, at least about ¾ actuated, alternatively, about fully actuated. Additionally or alternatively, the second valve 316 may be configured to actuate upon receipt of a signal, for example, from the sensor 322 (e.g., via the operation of the control system 324), for example, as similarly disclosed herein with respect to the first valve 314. In such an embodiment, the second valve may be configured to begin actuation after a suitable delay period, for example, a delay of about 1 sec., alternatively, about 2 secs., alternatively, about 3 secs., alternatively, about 4 secs., alternatively, about 5 secs., alternatively, about 10 secs., alternatively, about 15 secs., alternatively, about 20 secs., alternatively, about 30 secs.

Continuing to refer to FIG. 3, in an embodiment, the pressure control system 108 may comprise at least one relief space 131. In an embodiment, the relief space 131 may be in fluid communication, directly or indirectly, with the relief path 196. For example, in the embodiment of FIG. 3, the relief space 131 is generally configured and/or positioned to receive fluids communicated through the pressure control system 108 (i.e. through the relief path 196). In the embodiment of FIG. 3, the relief space 131 is associated with the relief path 196, for example, such that the relief path 196 will empty into the relief space 131. In an alternative embodiment, the relief path 196 may be fluidicly connected and/or coupled to the relief space 131. In an embodiment, the relief space 131 comprise any suitable configuration of space, tank, chamber, bladder, the like, or combinations thereof. In such an embodiment, the relief space 131 may be positioned on a trailer, for example, a trailer comprising all or a portion of the pressure control system. In an additional or alternative embodiment, the relief space 131 may comprise an annular space within the wellbore, a second wellbore, a pit located at or proximate to the wellsite or combinations thereof.

In an embodiment, any fluid(s) may initially be absent, or substantially absent, from the pressure control apparatus 108 (e.g., the relief path 196 and the relief space 131). For example, the relief path 196 and relief space 131 may initially comprise a dry or void (of fluid) space. In an embodiment, at least a portion of the relief path 196 may have a generally downward slope, for example, toward the relief space 131, such that fluid may readily flow into the relief space with the assistance of gravity.

Figure 4:
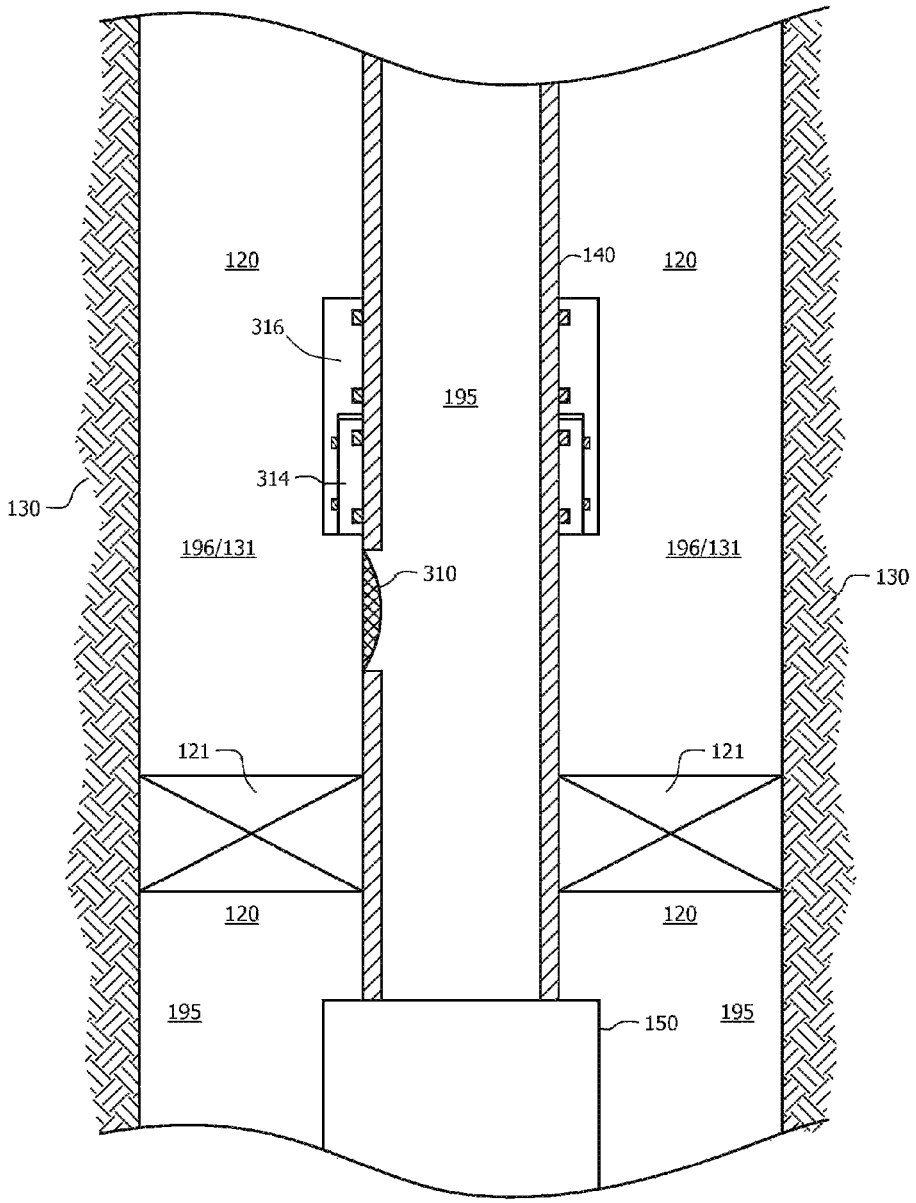
FIG. 4 is a partial cutaway view of a second embodiment of a pressure control system.

Referring to FIG. 4, a second embodiment of the pressure control system 108 is illustrated. In an embodiment, the second embodiment of the pressure control system 108 illustrated in FIG. 4 may be suitably incorporated/integrated within the flow path 195 at a position below the wellhead 180 (e.g., at location B, as shown in FIG. 1). For example, the second embodiment of the pressure control system 108 may be suitably incorporated and/or integrated within the pipe string 140. In the embodiment of FIG. 4, the pressure control system 108 similarly comprises a pressure control device 310, a relief flow path 196, and a relief space 131. In an embodiment, the pressure control system 108 (e.g., the second embodiment of the pressure control system 108 as shown in FIG. 4) may further comprise a first valve 314, and second valve, or combinations thereof.

As noted above, in the embodiment of FIG. 4, the pressure control system 108 may be integrated within the pipe string 140. In such an embodiment, the pressure control system 108 may be configured to provide fluid communication out of the pipe string 140 (e.g., radially outward, for example, into the formation 130), as will be disclosed herein. In an embodiment, the pressure control system 108 may be disposed within the pipe string 140 at a suitable depth, as will be appreciated by one of skill in the art upon viewing this disclosure.

Referring to FIG. 4, in an embodiment the relief path 196 and/or the relief space 131 (e.g., the relief path 196 and the relief space 131, together) may comprise at least a portion of an annular space 120 surrounding the pipe string 140. In such an embodiment, the relief path 196 and/or the relief space 131 may be at least partially defined by one or more isolating elements, such as packers 121 (for example, as illustrated in the embodiment of FIG. 4), by cement (e.g., a cement sheath disposed within a portion of the annular space), or combinations thereof. As will be appreciated by one of skill in the art upon viewing this disclose, in such an embodiment, the size of the relief path 196 and/or the relief space 131 may be varied dependent upon the size (e.g., diameter) of the wellbore 120 and/or the spacing (e.g., distance between) the isolating elements (e.g., the packers 121 and/or the cement sheath). Additionally, in an embodiment, the relief path 196 may extend into the formation (e.g., a flow path or route of fluid communication into or within the subterranean formation 130.

Referring again to FIG. 4, in the embodiment of FIG. 4, the pressure control device 310 may comprise any suitable type and/or configuration thereof, for example, as disclosed herein with respect to FIG. 3. For example, the pressure control device 310 may comprise a burst or rupture disc, a cap, and/or a flapper plate, as disclosed herein. In the embodiment of FIG. 4, the pressure control device is generally configured to permit fluid communication between the flow path 195 and the relief path 196 upon experiencing a differential pressure across the pressure control device 310 of at least the pressure threshold, as disclosed herein. In an embodiment, the pressure control device 310 may be disposed within a wall of the pipe string 140 (e.g., within a joint or section of the pipe string 140 and/or within a component configured to be similarly incorporated within the pipe string), for example, within a port, window, or other opening within a wall of the pipe string 140. In such an embodiment, the port, window, or other opening may be configured such that, upon actuation of the pressure control device 310, the port, window, or other opening will allow fluid communication between an axial flowbore of the pipe string 140 (e.g., flow path 195) and an exterior of the pipe string 140 (e.g., the annular space surrounding the pipe string 140).

In an embodiment, for example, as illustrated in the embodiment of FIG. 4, the pressure control system 108 comprises a first valve. In such an embodiment, the first valve 314 may comprise a sleeve slidably disposed around the pipe string 140, alternatively, within the pipe string 140. In such an embodiment, the first valve 314 (e.g., the sliding sleeve) may be configured to be movable between a first position, in which the sleeve does not block fluid communication via the port(s) or window(s) comprising the pressure control device 310 (e.g., as disclosed herein) and a second position in which the sleeve does block the port(s) or window(s). For example, the first valve 314 may slide axially along a portion of the pipe string 140 and/or rotationally around a portion of the pipe string 140 so as to selectively block or allow fluid communication from the axial flowbore of the pipe string 140 (e.g., the flow path 195) to an exterior of the pipe string 140 (e.g., the relief path 195 and/or the relief space 131). In an embodiment, the sleeve (e.g., the first valve 314) may comprise an aperture that is initially (e.g., when the sleeve is in the first position) aligned with the pressure control device 310 and/or the port(s) or window(s) comprising the pressure control device 310 and misaligned upon actuation of the sleeve (e.g., movement to the second position). In an embodiment, the first valve 314 (e.g., a sleeve) may be configured for movement from the first position to the second position via the operation of any suitable apparatus and/or method. For example, in an embodiment, the sleeve may be configured to be moved via the operation of an obturating member (e.g., a ball or dart) configured to engage a seat within the flow path 195 to thereby apply a pressure to the sleeve. Alternatively, the sleeve may be configured to be moved via the operation of a remote shifting tool configured to engage a lug, dog, key, catch, or the like associated with sleeve and thereby move the sleeve relative to the pipe string 140. Alternatively, the sleeve may be configured to be moved via a remote signal (e.g., an acoustic signal, a radio frequency signal, a magnetic signal, or any other suitable signal), received by a transponder associated with the sleeve and configured, upon receipt of such signal, to cause the sleeve to be transitioned from the first position to the second position. Alternatively, the sleeve may be configured to be moved via the application of a fluid pressure to the sleeve, for example, which may act upon a differential in the exposed surface areas of the sleeve to cause movement of the sleeve. Alternatively, the sleeve may be biased in the closed direction (for example via a spring or hydraulic piston/force) and held open via a structural interaction between the sleeve and the pressure control device 310 in an intact or un-activated state. For example, a lower end of the sleeve may be biased against a burst or rupture disk (thereby serving as a brake holding the biased sleeve open), and upon bursting or rupture of the disk the brake is released and the sleeve is transitioned from an open to closed state. The rate at which the sleeve transitions from closed to open can be controlled as disclosed herein, for example via a fluidic or hydraulic timer/diode.

In an embodiment, the pressure control system 108 comprises a second valve 316. In such an embodiment, the second valve 316 may generally comprise a second movable sleeve, for example, as disclosed herein with reference to the first valve 314. For example, the second sleeve may be disposed over the first sleeve; alternatively, within the first sleeve. Alternatively one of the first or second sleeves may be disposed within the pipe string 140 and the other disposed around the pipe string 140. Various suitable additional and/or alternative sleeve configurations may be appreciated by one of skill in the art upon viewing this application.

In an embodiment, a pressure control system, such as the pressure control system 108 disclosed herein, may be employed in the performance of a wellbore servicing operation. In such an embodiment, a wellbore servicing method may generally comprise the steps of providing a wellbore servicing system (for example, the wellbore servicing system 100 disclosed herein), providing a flow path (for example, flow path 195, disclosed herein) comprising a pressure control system (e.g., the pressure control system 108 disclosed herein), and introducing a fluid into the wellbore 120 via the flow path. In an embodiment, the wellbore servicing method may further comprise allowing a pressure of at least a pressure threshold to dissipate from the flow path, and reestablishing control of the flow path.

In an embodiment, providing the wellbore servicing system may comprise transporting one or more wellbore servicing equipment components, for example, as disclosed herein with respect to FIGS. 1 and 2, to a wellsite 101. In an embodiment, the wellsite 101 comprises a wellbore 120 penetrating a subterranean formation 130. In an embodiment, the wellbore may be at any suitable stage. For example, the wellbore 120 may be newly drilled, alternatively, newly completed, alternatively, previously completed and produced, or the like. As will be appreciated by one of skill in the art upon viewing this application, the wellbore servicing equipment components that are brought to the wellsite 101 (e.g., which will make up the wellbore servicing system 100) may vary dependent upon the wellbore servicing operation that is intended to be performed.

In an embodiment, providing a flow path (for example, flow path 195 disclosed herein) comprising a pressure control system 108 may comprise assembling the wellbore servicing system 100, coupling the wellbore servicing system 100 to the wellbore 120, providing a pipe string within the wellbore, or combinations thereof. For example, in an embodiment, one or more wellbore servicing equipment components may be assembled (e.g., fluidicly coupled) so as to form the wellbore servicing system 100, for example, as illustrated in FIG. 2. Also, in an embodiment, the wellbore servicing system 100 may be fluidicly coupled to the wellbore. For example, in the embodiment illustrated by FIG. 2, the manifold 250 may be fluidicly coupled to the wellhead 180. Further, in an embodiment, a pipe string (such as pipe string 140) may be run into the wellbore to a predetermined depth; alternatively, the pipe string 140 may already be present within the wellbore 120.

In an embodiment, providing the flow path 195 comprising a pressure control system 108 may also comprise fluidicly coupling the pressure control system 108 to the flow path, incorporating the pressure control system 108 within the flow path 195, or combinations thereof. For example, in an embodiment, the pressure control system 108 may be fluidicly connected, for example, as disclosed with respect to FIG. 3, during assembly of the wellbore servicing system 100 and/or as a part of coupling the wellbore servicing system 100 to the wellbore 120. Alternatively, in an embodiment, the pressure control system 108 may be integrated within one or more components present at the wellsite 101. For example, in an embodiment, the pressure control system 108 may be integrated/incorporated within (e.g., a part of) the pipe string 140, for example, as disclosed with respect to FIG. 4.

In an embodiment, (for example, when the flow path 195 has been provided) a fluid may be introduced into the wellbore via the flow path 195. In an embodiment, the fluid may comprise a wellbore servicing fluid. Examples of a suitable wellbore servicing fluid include, but are not limited to, a fracturing fluid, a perforating or hydrajetting fluid, an acidizing fluid, the like, or combinations thereof. Additionally, in an embodiment, the wellbore servicing fluid may comprise a composite fluid, for example, having two or more fluid components which may be communicated into the wellbore separately (e.g., via two or more different flow paths). The wellbore servicing fluid may be communicated at a suitable rate and pressure for a suitable duration. For example, the wellbore servicing fluid may be communicated at a rate and/or pressure sufficient to initiate or extend a fluid pathway (e.g., a perforation or fracture) within the subterranean formation 130 and/or a zone thereof.

In an embodiment, for example, as shown in FIGS. 1 and 2, as the fluid is introduced into the wellbore 120 via flow path 195, the fluid (e.g., the wellbore servicing fluid) may be in fluid communication with the pressure control system 108. In such an embodiment, the pressure control system 108 may experience the fluid pressure associated with the wellbore servicing fluid.

In an embodiment, the wellbore servicing method further comprises allowing a pressure of at least the pressure threshold to dissipate from the flow path 195. For example, while undesirable, it is possible that the pressure (e.g., fluid pressure) within some portion of the flow path 195 may reach and/or exceed a desired pressure threshold, for example, as disclosed herein, for example, an "over-pressuring" situation. Such an over-pressuring situation may result for one or more of many reasons, for example, failure or malfunction of wellbore servicing equipment, such as a pump failing to disengage or a valve failing to open or close, an unexpected obstruction within the flow path 195, unexpected pressures from the formation encountered during the performance of a servicing operation, or various other reasons. Regardless of the reason for such an over-pressuring situation, upon the occurrence of such an event, the pressure within the flow path 195 may rise very quickly. For example, because the high pressure and high flow-rate fluids utilized during the performance of a wellbore servicing operation, the possibility exists that the pressures within the flow path 195 may increase very rapidly. For example, in an embodiment, upon the occurrence of such an event, the pressure within the flow path may increase at a rate of greater than about 500 psi/sec., alternatively, greater than about 1,000 psi/sec., alternatively, greater than about 2,000 psi/sec., alternatively, greater than about 4,000 psi/sec., alternatively, greater than about 6,000 psi/sec., alternatively, greater than about 8,000 psi/sec., alternatively, greater than about 10,000 psi/sec, for example, as may vary dependent upon one or more of volume, rigidity of constraints and fluid compressibility, Bulk Modulus, or combinations thereof.

In an embodiment, upon experiencing a pressure or pressure differential, as disclosed herein, of at least the pressure threshold, the pressure control system 108 may be configured to allow at least a portion of the pressure within the flow path 195 to be released. For example, upon experiencing a pressure or pressure differential of at least the pressure threshold, the pressure control device 310 may be configured to allow fluid to be communicated out of the flow path 195 and via the relief path 196. For example, where the pressure control device 310 comprises a burst (or rupture) disc, the burst disc may break, shatter, burst, separate, or otherwise allow fluid to be communicated therethrough (e.g., into the relief path 196). Not intending to be bound by theory, because the pressure control device 310 may comprise a fast-acting device, the pressure within the flow path 195 may be released prior to the pressure rising to an unsafe and/or unintended level. As such, wellbore servicing equipment components (e.g., one or more components of the wellbore servicing system 100) may never experience unsafe, damaging, or otherwise unintended pressures. As will be appreciated by one of skill in the art upon viewing this disclosure, the pressure threshold (e.g., at which the pressure control device 310 is intended to allow fluid communication) may be selected at a pressure less than the pressure which is desired to not be experienced (e.g., a pressure "safety" margin). For example, the pressure threshold may be selected so as to allow a margin of about 100 psi, alternatively, about 150 psi, alternatively, about 200 psi, alternatively, about 250 psi, alternatively, about 300 psi, alternatively, about 400 psi, alternatively, about 500 psi, alternatively, about 1,000 psi, alternatively, about 2,000 psi, alternatively, any other desired differential.

In an embodiment, upon the pressure control device 310 allowing fluid communication from the flow path 195 to the relief path 196, fluid may be communicated via the relief path 196 and into the relief space 131. For example, in an embodiment where the pressure control system 108 is configured for placement at the surface of the formation (e.g., as disclosed with reference to FIG. 3), the fluid may flow through the first valve 314 and/or the second valve 316, which are initially provided so as to allow fluid communication and into a vessel, tank, pit, or other space. Alternatively, in an embodiment where the pressure control system 108 is configured for placement within the wellbore and/or within the formation (e.g., as disclosed with reference to FIG. 4), the fluid may flow through the ports or windows within the pipe string 140 (e.g., ports or windows which house the pressure control device 310), past the first valve 314, which is initially provided so as to allow fluid communication, and into the annular space surrounding the pipe string 140 (e.g., the annular space between the pipe string 140 and the walls of the wellbore 120). Additionally, in an embodiment, at least a portion of the fluid may flow into the formation surrounding the wellbore 120 (or a zone thereof), for example, via one or more induced or naturally-occurring fractures, porous regions, and/or vugular regions. In an embodiment, the release of fluid from the flow path 195 via the relief path 196 may be effective to substantially relieve and/or dissipate pressure within the flow path 195 in excess of the pressure threshold.

In an embodiment, the wellbore servicing method may also comprise reestablishing control of the flow path. For example, as disclosed herein, upon experiencing an overpressuring event, the pressure control system 108 (particularly, the pressure control device 310, for example, a burst disc) is actuated so as to release and/or dissipate pressure (e.g., fluid) from the flow path 195. For example, upon actuation of the pressure control system 108 (i.e., the pressure control device 310), the flow path 195 (e.g., via the relief path 196, which is in fluid communication with the flow path 195) is effectively open, thereby allowing fluid within the flow path 195 to escape. As will be appreciated by one of skill in the art upon viewing this disclosure, control of the flow path 195 (e.g., and therefore, the wellbore 120) must be reestablished, for example, such that fluid(s) from the wellbore 120 and/or the formation 130 do not escape uncontrollably therefrom. In an embodiment, reestablishing control of the flow path 195 may comprise actuating the first valve 314, for example closing the first valve 314.

In an embodiment, and as disclosed herein, the first valve 314 may be configured to close at a controlled rate, for example, so as to avoid a pressure wave becoming trapped within the flow path 195. In an embodiment, the first valve 314 may be closed at a rate so as to allow such a pressure wave to be dissipated. As disclosed herein, the first valve 314 may be actuated (e.g., closed) hydraulically, pneumatically, electrically (e.g., via the operation of a solenoid and/or a motor), manually, or combinations thereof and such actuation may comprise an automated function (e.g., as a function of a sensor, such as sensor 322 and/or a control system, such as control system 324), alternatively, a manual function, alternatively, combinations thereof.

In an embodiment, as the first valve 314 is actuated (e.g., closed), fluid communication via the relief path 196 may be reduced. Not intending to be bound by theory, because of the relatively high pressures, high flow-rates, and/or abrasive nature of the fluid(s) being communicated via the flow path 195 and the relief path 196, the first valve 314 may be abraded or damaged during the actuation (closing) thereof, for example, by the movement of an abrasive fluid moving therethrough at a high pressure and a high rate while the first valve 314 is closed. For example, the movement of fluid through the first valve 314 while the first valve 314 is being closed may cut, abrade, or perforate small flow channels through a portion of the first valve 314.

In an embodiment, reestablishing control of the flow path 195 may further comprise actuating the second valve 316, for example closing the second valve 316. For example, as disclosed herein, the second valve 316 may be configured such that the second valve 316 is not fully actuated (e.g., does not reach the closed position) until after the first valve 314 has been fully actuated (e.g., until after the first valve 314 has been fully closed). Again not intending to be bound by theory, because the second valve 316 is not fully actuated until after the first valve 314 has been fully actuated, the flow-rate and pressure of the fluid within the relief path 196 at the second valve 316 (e.g., at the time when the second valve 316 is actuated) may be substantially lessened. As such, the movement of fluid through the second valve 316 (e.g., at a substantially lower pressure and/or pressure, relative to the fluid moved through the first valve 314, as disclosed herein) will not damage (e.g., abrade or cut) the second valve 316, thereby allow the second valve 316 to fully contain the relief path 196 and, thereby, the flow path 195. For example, closing the second valve 316 may provide absolute containment of fluid within the flow path 195, for example, if the first valve 314 fails due to erosion while being closed.

In an embodiment, a pressure control system, for example, the pressure control system 108 disclosed herein, and/or systems or methods utilizing the same, may be advantageously employed in the performance of a wellbore servicing operation. As disclosed herein, a pressure control system may be effective to protect one or more wellbore servicing equipment components from unexpected and/or unintended increases in fluid pressure (e.g., pressure spikes or over-pressuring events) and, as such, prevent the occurrence of any yield to such components.

Particularly, a pressure control system, as disclosed herein, may be effective to relieve or dissipate pressure where conventional means of pressure control would be ineffective. For example, conventionally, various combinations of relief valves (e.g., pop-off valves, as referenced herein) and/or check valves have been employed to alleviate excess pressure. However, such conventional means may not be capable of reacting quickly enough (e.g., not capable of actuating fast enough) to respond to a sudden increases in pressure in order to protect the equipment and equipment operators. As disclosed herein, because of the high pressures and flow rates utilized in wellbore servicing operations, it is possible that pressures within a flow path could increase to levels to damage equipment and/or personnel before such excess pressures could be relieved. Particularly, and not intending to be bound by theory, because such conventional pressure control means (i.e., relief valves, such as pop-off valves) generally comprise mechanical (biased or spring-loaded devices), a delay in time may be experienced between when an excess pressure was experienced and when that pressure might be relieved. As disclosed herein, the pressure control system 108 is configured to react quickly and, thereby, to relieve pressures so as to prohibit wellbore servicing equipment components from experiencing such pressures and, thereby, to protect the equipment and the equipment operators.

Additional Disclosure

The following are nonlimiting, specific embodiments in accordance with the present disclosure:

A first embodiment, which is a wellbore servicing system, the system comprising:

at least one wellbore servicing equipment component, wherein a flow path extends from the wellbore servicing system component into a wellbore penetrating a subterranean formation; and a pressure control system in fluid communication with the flow path, wherein the pressure control system comprises:

a relief path configured to communicate fluid through the pressure control system, a pressure control device configured to permit fluid communication between the flow path and the relief path upon experiencing a pressure and/or a differential pressure of at least a predetermined pressure threshold; and a first valve disposed within the relief path, wherein the first valve is configured to actuate from an open configuration to a closed configuration.

A second embodiment, which is the wellbore servicing system of the first embodiment, wherein the wellbore servicing equipment component comprises a mixer, a pump, a wellbore services manifold, a storage vessel, or combinations thereof.

A third embodiment, which is the wellbore servicing system of one of the first through the second embodiments, wherein the pressure control device comprises a rupture disc.

A fourth embodiment, which is the wellbore servicing system of the third embodiment, wherein, upon experiencing the pressure and/or the differential pressure of at least the predetermined pressure threshold, the rupture disc is configured to break, puncture, perforate, shear, fragment, disintegrate, explode, implode, tear, or combinations thereof.

A fifth embodiment, which is the wellbore servicing system of one of the first through the fourth embodiments, wherein the pressure threshold is in a range from about 1,000 psi to about 30,000 psi.

A sixth embodiment, which is the wellbore servicing system of one of the first through the fifth embodiments, wherein the pressure control device configured to permit fluid communication in less than or equal to about 0.10 seconds of experiencing the pressure and/or the differential pressure of at least the predetermined pressure threshold.

A seventh embodiment, which is the wellbore servicing system of one of the first through the sixth embodiments, wherein the first valve comprises a gate valve, a ball valve, a globe valve, a choke valve, a butterfly valve, a pinch valve, a disc valve, the like, or combinations thereof.

An eighth embodiment, which is the system of one of the first through the seventh embodiments, wherein the first valve comprises a sleeve, wherein the sleeve is slidably disposed about or within a pipe string.

A ninth embodiment, which is the wellbore servicing system of one of the first through the eighth embodiments, wherein the pressure control system further comprises a flow restrictor, wherein the flow restrictor is configured to decrease the pressure of a fluid communication along the relief path from the pressure control device to the first valve.

A tenth embodiment, which is the wellbore servicing system of the ninth embodiment, wherein the flow restrictor comprises a choke, a fluidic diode, or combinations thereof.

An eleventh embodiment, which is the wellbore servicing system of one of the first through the tenth embodiments, wherein the pressure control system further comprises a second valve disposed within the relief path downstream from the first valve, wherein the second valve is configured to actuate from an open configuration to a closed configuration.

A twelfth embodiment, which is the wellbore servicing system of one of the first through the eleventh embodiments, wherein the pressure control system further comprises a relief space, wherein the relief path is in fluid communication with the relief space.

A thirteenth embodiment, which is the wellbore servicing system of the twelfth embodiment, wherein the relief space comprises a tank, a vessel, a wellbore, an annular space within a wellbore, a second wellbore, a portion of the subterranean formation, or combinations thereof.

A fourteenth embodiment, which is the wellbore servicing system of one of the first through the thirteenth embodiments, wherein at least a portion of the pressure control system is disposed at the surface of the subterranean formation.

A fifteenth embodiment, which is the wellbore servicing system of one of the first through the fourteenth embodiments, wherein at least a portion of the pressure control system is disposed within the wellbore.

A sixteenth embodiment, which is the wellbore servicing system of the fifteenth embodiment, wherein the pressure control system is integrated within a pipe string disposed within the wellbore.

A seventeenth embodiment, which is a method of servicing a wellbore, the method comprising:

providing a flow path between a wellbore servicing system and a wellbore penetrating a subterranean formation, wherein a pressure control system comprising a pressure control device and a relief path is in fluid communication with the flow path, wherein the pressure control system is configured to control fluid communication between the flow path and the relief path;

communicating a fluid via the flow path; and upon experiencing a pressure and/or a differential pressure of at least a predetermined pressure threshold within the flow path, allowing fluid to be communicated from the flow path through the relief path, wherein the pressure control device permits fluid communication from the flow path to the relief path within about 0.10 seconds of experiencing the pressure and/or the differential pressure of at least the predetermined pressure threshold.

An eighteenth embodiment, which is the method of the seventeenth embodiment, wherein the fluid is communicated from the relief path to a relief space.

A nineteenth embodiment, which is the method of one of the seventeenth through the eighteenth embodiments, further comprising closing a first valve, wherein the first valve is positioned along the relief path.

A twentieth embodiment, which is the method of the nineteenth embodiment, further comprising closing a second valve, wherein the second valve is positioned along the relief path downstream from the first valve.

A twenty-first embodiment, which is the method of the twentieth embodiment, wherein closing the first valve, closing the second valve, or both occurs manually.

A twenty-second embodiment, which is the method of the twentieth embodiment, wherein closing the first valve, closing the second valve, or both occurs automatically as a result of fluid communication via the relief path.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing system, the system comprising:

at least one wellbore servicing equipment component, wherein a flow path extends from the wellbore servicing system component into a wellbore penetrating a subterranean formation; and a pressure control system in fluid communication with the flow path, wherein the pressure control system comprises:

a relief path configured to communicate fluid through the pressure control system, a pressure control device configured to permit fluid communication between the flow path and the relief path upon experiencing a pressure and/or a differential pressure of at least a predetermined pressure threshold;

a first valve disposed along the relief path and downstream of the pressure control device, wherein the first valve is configured to actuate from a first valve open configuration to a first valve closed configuration and to prevent fluid communication through the relief path when the first valve is in the first valve closed configuration; and a second valve disposed within the relief path downstream from the first valve, wherein the second valve is configured to actuate from a second valve open configuration to a second valve closed configuration.

2. The wellbore servicing system of claim 1, wherein the wellbore servicing equipment component comprises a mixer, a pump, a wellbore services manifold, a storage vessel, or combinations thereof.

3. The wellbore servicing system of claim 1, wherein the pressure control device comprises a rupture disc.

4. The wellbore servicing system of claim 3, wherein, upon experiencing the pressure and/or the differential pressure of at least the predetermined pressure threshold, the rupture disc is configured to break, puncture, perforate, shear, fragment, disintegrate, explode, implode, tear, or combinations thereof.

5. The wellbore servicing system of claim 1, wherein the pressure threshold is in a range from about 1,000 psi to about 30,000 psi.

6. The wellbore servicing system of claim 1, wherein the pressure control device configured to permit fluid communication in less than or equal to about 0.10 seconds of experiencing the pressure and/or the differential pressure of at least the predetermined pressure threshold.

7. The wellbore servicing system of claim 1, wherein the first valve comprises a gate valve, a ball valve, a globe valve, a choke valve, a butterfly valve, a pinch valve, a disc valve, or combinations thereof.

8. The system of claim 1, wherein the first valve comprises a sleeve, wherein the sleeve is slidably disposed about or within a pipe string.

9. The wellbore servicing system of claim 1, wherein the pressure control system further comprises a flow restrictor, wherein the flow restrictor is configured to decrease the pressure of a fluid communication along the relief path from the pressure control device to the first valve.

10. The wellbore servicing system of claim 9, wherein the flow restrictor comprises a choke, a fluidic diode, or combinations thereof.

11. The wellbore servicing system of claim 1, wherein the pressure control system further comprises a relief space, wherein the relief path is in fluid communication with the relief space.

12. The wellbore servicing system of claim 11, wherein the relief space comprises a tank, a vessel, a wellbore, an annular space within a wellbore, a second wellbore, a portion of the subterranean formation, or combinations thereof.

13. The wellbore servicing system of claim 1, wherein at least a portion of the pressure control system is disposed at the surface of the subterranean formation.

14. The wellbore servicing system of claim 1, wherein at least a portion of the pressure control system is disposed within the wellbore.

15. The wellbore servicing system of claim 14, wherein the pressure control system is integrated within a pipe string disposed within the wellbore.

16. A method of servicing a wellbore, the method comprising:

providing a flow path between a wellbore servicing system and a wellbore penetrating a subterranean formation, wherein a pressure control system comprising a pressure control device and a relief path is in fluid communication with the flow path, wherein the pressure control system is configured to control fluid communication between the flow path and the relief path;

communicating a fluid via the flow path;

upon experiencing a pressure and/or a differential pressure of at least a predetermined pressure threshold within the flow path, allowing fluid to be communicated from the flow path through the relief path, wherein the pressure control device permits fluid communication from the flow path to the relief path within about 0.10 seconds of experiencing the pressure and/or the differential pressure of at least the predetermined pressure threshold; and closing a first valve positioned along the relief path and downstream of the pressure control device, wherein the first valve prevents fluid communication through the relief path when the first valve is closed; and closing a second valve, wherein the second valve is positioned along the relief path downstream from the first valve.

17. The method of claim 16, wherein the fluid is communicated from the relief path to a relief space.

18. The method of claim 16, wherein closing the first valve, closing the second valve, or both occurs manually.

19. The method of claim 16, wherein closing the first valve, closing the second valve, or both occurs automatically as a result of fluid communication via the relief path.

* * * * *